US012350783B2

(12) United States Patent
Allison

(10) Patent No.: US 12,350,783 B2
(45) Date of Patent: Jul. 8, 2025

(54) CLAMPING ASSEMBLY FOR A BLADE SHARPENER

(71) Applicant: Clay A. Allison, Santa Fe, NM (US)

(72) Inventor: Clay A. Allison, Santa Fe, NM (US)

( * ) Notice: Subject to any disclaimer, the term of this patent is extended or adjusted under 35 U.S.C. 154(b) by 511 days.

(21) Appl. No.: 17/837,299

(22) Filed: Jun. 10, 2022

(65) Prior Publication Data

US 2023/0398653 A1 Dec. 14, 2023

(51) Int. Cl.
*B24B 3/54* (2006.01)

(52) U.S. Cl.
CPC ..... *B24B 3/54* (2013.01)

(58) Field of Classification Search
CPC .. B25B 5/062; B25B 5/08; B25B 5/12; B25B 13/32; B24B 3/36; B24B 3/52; B24B 3/54; B24D 15/063; B24D 15/065; B24D 15/08; F16B 2/10
USPC ..... 269/228, 234
See application file for complete search history.

(56) References Cited

U.S. PATENT DOCUMENTS

| | | | |
|---|---|---|---|
| 3,640,900 | A | 5/1887 | Clayton |
| 1,506,643 | A | 8/1924 | Johnson |
| 2,116,343 | A | 5/1938 | Davis |
| 2,127,289 | A | 8/1938 | Corrall et al. |
| 2,142,105 | A | 1/1939 | Blankner |
| 2,157,816 | A | 5/1939 | Carosi |
| 2,191,899 | A | 2/1940 | Primak |
| 2,259,095 | A | 10/1941 | Aiello, Sr. |
| 2,370,908 | A | 3/1945 | Llorens |
| 2,397,256 | A | 3/1946 | Foster |
| 2,528,943 | A | 11/1950 | Calabrese |
| 2,809,539 | A | 10/1957 | Hennessy |
| 3,219,376 | A | 11/1965 | Peters |

(Continued)

FOREIGN PATENT DOCUMENTS

| | | | |
|---|---|---|---|
| CA | 2331369 | A1 | 11/1999 |
| CA | 2367189 | A1 | 7/2002 |

(Continued)

OTHER PUBLICATIONS

Eastwood, "Pinch Weld Clamps," available at https://www.eastwood.com/pinch-weld-clamps.html?gclid=EAlalQobChMlqJnHqJy_7QIVy_rICH3WBg-_ EAkYBiABEgloVvD_BwE (accessed on Dec. 8, 2020).

(Continued)

*Primary Examiner* — Eric J Rosen
*Assistant Examiner* — Aaron R McConnell
(74) *Attorney, Agent, or Firm* — Finch & Maloney PLLC

(57) ABSTRACT

A clamping assembly includes a base defining a spring well. A spring piston assembly is received in the spring well and includes a spring and a piston body. First and second jaws are supported over the base on opposite sides of a central clamp axis that extends vertically through the spring piston and between the jaws, where the jaws are pivotable between an open position and a closed position. A wedge is movable along the central clamp axis between an end of the jaws. A lever has an elongated lever body extending to an end portion defining an L-shape with a toe and a heel, the end portion positioned between the wedge and the spring piston with the toe pivotably connected to the wedge and the heel coupled to the piston body via a linkage. The lever is operable to move the wedge along the central clamp axis.

20 Claims, 11 Drawing Sheets

(56) References Cited

U.S. PATENT DOCUMENTS

| | | | | |
|---|---|---|---|---|
| 3,630,391 | A | 12/1971 | Wilson | |
| 4,216,627 | A | 8/1980 | Westrom | |
| 4,217,735 | A | 8/1980 | McGeoch et al. | |
| 4,404,873 | A | 9/1983 | Radish | |
| 4,441,279 | A | 4/1984 | Storm et al. | |
| 4,471,951 | A | 9/1984 | LeVine | |
| 4,512,112 | A | 4/1985 | LeVine | |
| 4,538,382 | A | 9/1985 | Johannsen | |
| 4,602,531 | A | 7/1986 | Korhonen | |
| 4,624,079 | A | 11/1986 | Bonapace | |
| 4,714,239 | A | 12/1987 | LeVine | |
| 4,731,953 | A | 3/1988 | Owen | |
| 4,745,660 | A | 5/1988 | Betts et al. | |
| 4,777,770 | A | 10/1988 | LeVine | |
| 4,912,885 | A | 4/1990 | Bonapace | |
| 4,955,593 | A | 9/1990 | Yang | |
| 4,961,288 | A | 10/1990 | Ketteringham | |
| 5,157,870 | A | 10/1992 | Pike | |
| 5,185,958 | A | 2/1993 | Dale | |
| 5,195,275 | A | 3/1993 | McLean | |
| 5,218,787 | A | 6/1993 | Rice | |
| 5,318,004 | A | 6/1994 | Peck | |
| 5,363,602 | A | 11/1994 | Anthon et al. | |
| 5,431,068 | A | 7/1995 | Alsch | |
| 5,477,753 | A | 12/1995 | Branscum et al. | |
| 5,906,534 | A | 5/1999 | Flokman et al. | |
| 6,003,360 | A | 12/1999 | Runk et al. | |
| 6,146,257 | A | 11/2000 | Himeno et al. | |
| 6,168,509 | B1 | 1/2001 | Presgrove | |
| 6,366,480 | B2 | 4/2002 | Hosotani | |
| 6,505,871 | B2 | 1/2003 | McCormick | |
| 6,579,163 | B1 | 6/2003 | Ross et al. | |
| 6,659,439 | B1 | 12/2003 | Baumgartner et al. | |
| 6,726,551 | B2 | 4/2004 | Friel, Sr. | |
| 6,763,819 | B2 | 7/2004 | Eckert | |
| 7,019,510 | B1 | 3/2006 | Bradley | |
| 7,052,385 | B1 | 5/2006 | Swartz | |
| 7,144,310 | B2 | 12/2006 | Longbrake | |
| 7,413,504 | B2 | 8/2008 | Lytinas | |
| 7,867,062 | B2 | 1/2011 | Swartz | |
| 8,016,279 | B1 | 9/2011 | Su | |
| 8,262,438 | B1 | 9/2012 | Allison et al. | |
| 8,512,103 | B2 * | 8/2013 | Dovel | B24B 9/04 451/449 |
| 8,544,919 | B2 | 10/2013 | Oh et al. | |
| 8,794,612 | B2 | 8/2014 | Chuang | |
| 9,216,488 | B2 | 12/2015 | Allison | |
| 9,452,508 | B2 | 9/2016 | Beechinor et al. | |
| 9,878,483 | B2 | 1/2018 | Leroux | |
| 10,131,028 | B1 | 11/2018 | Allison | |
| 10,774,614 | B2 | 8/2020 | Allison | |
| 11,052,512 | B1 | 7/2021 | Allison | |
| 2002/0074705 | A1 | 7/2002 | Marusiak | |
| 2004/0077299 | A1 | 4/2004 | Friel, Sr. | |
| 2005/0048885 | A1 | 3/2005 | Longbrake | |
| 2005/0090184 | A1 | 4/2005 | Zhang et al. | |
| 2006/0086208 | A1 | 4/2006 | Gshwind, Sr. et al. | |
| 2006/0162707 | A1 * | 7/2006 | Peck | F41A 19/16 124/35.2 |
| 2007/0218819 | A1 | 9/2007 | Schwaiger et al. | |
| 2007/0249268 | A1 | 10/2007 | Swartz | |
| 2008/0096477 | A1 | 4/2008 | Lytinas | |
| 2008/0214095 | A1 * | 9/2008 | Dovel | B24B 3/34 76/82 |
| 2008/0223101 | A1 | 9/2008 | Moeck et al. | |
| 2009/0088053 | A1 | 4/2009 | Hummel | |
| 2009/0183956 | A1 | 7/2009 | Berliant | |
| 2010/0295227 | A1 | 11/2010 | Hung | |
| 2011/0159791 | A1 | 6/2011 | Heng | |
| 2011/0177764 | A1 | 7/2011 | Schwartz | |
| 2012/0146351 | A1 | 6/2012 | Oh et al. | |
| 2012/0326375 | A1 | 12/2012 | Chuang | |
| 2013/0160613 | A1 * | 6/2013 | Brailey | B25B 13/32 81/111 |
| 2013/0234382 | A1 | 9/2013 | Hofmann | |
| 2014/0335765 | A1 | 11/2014 | Allison | |
| 2016/0184979 | A1 * | 6/2016 | Roesch | B25B 5/006 81/367 |
| 2017/0173843 | A1 | 6/2017 | Leroux | |
| 2020/0338682 | A1 | 10/2020 | Allison | |
| 2022/0180116 | A1 | 6/2022 | Dodeja et al. | |

FOREIGN PATENT DOCUMENTS

| | | | |
|---|---|---|---|
| EP | 0910497 | A1 | 4/1999 |
| JP | 352051661 | A | 4/1977 |
| WO | 9106403 | | 5/1991 |
| WO | 2004037488 | A1 | 5/2004 |
| WO | 2007048165 | A1 | 5/2007 |

OTHER PUBLICATIONS

B&H Photo-Video-Pro Audio, "Ikan Elements Pinch Clamp," available at https://www.bhphotovideo.com/c/product/820612-REG/Ikan_ELE_PN_Elements_Pinch_Clamp.html (accessed Feb. 24, 2021).

United States Patent and Trademark Office, Non-Final Office Action issued in U.S. Appl. No. 16/927,239, filed Oct. 6, 2022.

* cited by examiner

CLAMPING ASSEMBLY FOR A BLADE SHARPENER

TECHNICAL FIELD

The present disclosure relates to a clamping assembly and to a sharpening apparatus that includes the clamping assembly.

BACKGROUND

Cutting edges have been sharpened throughout history using a variety of methods. In one example, the blade of a knife or other tool is drawn by hand against a hone, such as a whetstone. In another example, the blade is held against a rotating abrasive wheel. The abrasive grit size of the hone can be selected to achieve the finished edge as desired, from rough sharpening to fine sharpening and polishing the cutting edge to a mirror finish. A variety of techniques can be used, depending on the type of tool to be sharpened, the shape of the tool's cutting edge, the desired sharpness and durability of the edge, and other factors. In many sharpening methods, the blade to be sharpened is maintained at a particular angle with respect to the hone, such as by gripping in one's hand or using a shim.

SUMMARY

One aspect of the present disclosure is directed to a clamping assembly suitable to hold a work piece during sharpening operations. In one embodiment, the clamping assembly includes a base oriented in a horizontal plane. Spaced-apart jaws are pivotably connected above the base such that spreading the proximal ends of the jaws causes the distal ends of the jaws to pivot towards a closed position. A wedge can be advanced between the proximal ends of the jaws along a central clamp axis by moving a lever from a first position to a second position. In one embodiment, the wedge comprises a yoke with cams attached to the yoke with a pin so that each cam can pivot about the pin as the cam engages the inside surface of the jaw. Each cam can be a smooth surface or a roller, for example. Moving the lever to the second lever position advances the wedge along the central clamp axis (e.g., upward) between the proximal end portions of jaws, causing the distal ends of the jaws to pivot towards a closed position.

In one embodiment, proximal lever end portion generally has an L-shape with a toe extending away from the extended lever body, and also defining a heel at the lever body. With the lever positioned in front of the jaws and proximal lever end portion beneath the wedge, the toe extends rearward and is coupled to the yoke assembly using a pin. The heel is coupled via a linkage to a spring piston below the proximal lever end portion. Moving the lever from the first lever position (e.g., extending upward and forward) to the second lever position (e.g., extending forward), pivots the heel rearward towards the central clamp axis and at the same time pivots the toe upward with the wedge. As the jaws close and engage the workpiece during movement of the lever towards the second lever position, force is transferred to the spring piston in the base such that additional movement of the lever to the second lever position is taken up by compressing the spring piston.

In one example, the linkage initially is inclined upward and forward toward the handle body when the lever is in the first lever position. As the lever moves to the second lever position, the linkage attains a vertical position along the central clamp axis and then finally moves to be inclined upward and rearward when the lever is moved fully to the second lever position. Due to the lower energy of the linkage in the second lever position, the lever is in a stable or "locked" position that requires some force to move the lever out of the second lever position and back towards the first lever position and to release the jaws on the workpiece. Moving the lever out of the second lever position involves slightly compressing the spring piston to return the linkage to its vertical position, after which the lever continues towards the first lever position with the linkage shifting to a forward inclined position. In one such embodiment, the lever extends generally horizontally in front of the clamp assembly when it is in the second lever position. The user may push up on the lever to transition out of the second lever position and start moving the lever to the first lever position in which the lever extends upward and forward, for example.

In some embodiments, one or both of the jaws can define a plurality of tines arranged to grip the blade or other workpiece. For example, each jaw defines two or more tines extending vertically. Individual tines can include an inwardly projecting gripping surface. By providing a series of protrusions along the jaw in varying locations, the gripping surfaces assist in clamping knives that do not have parallel side faces by creating additional points of contact between the gripping surface and the face of the knife blade. The inwardly projecting gripping surface of some tines can have a different geometry compared to the gripping surface of other tines. For example, one gripping surface can have a greater or smaller vertical height, can protrude toward the median plane by a greater or lesser amount, can have a larger or smaller width, for example. In some embodiments, spaces between the protruding gripping surfaces accept the thicker area of the blade and the protrusions themselves fill the space between the primary surface of the jaw face the thinner portions of the knife blade. Other tines can have a generally planar inside face. In some such embodiments, the tines can be configured to deform temporarily during clamping to conform to the shape of the blade. In essence, both the protruding tines (which can be configured in a variety of ways) and planar tines work together to allow the jaws to conform to the shape of the knife blade while maximizing contact and clamping force. Tines configured in this way can better grip blades that have rounded lateral faces, a blade thickness that changes along the length of the blade, or other complex geometry.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
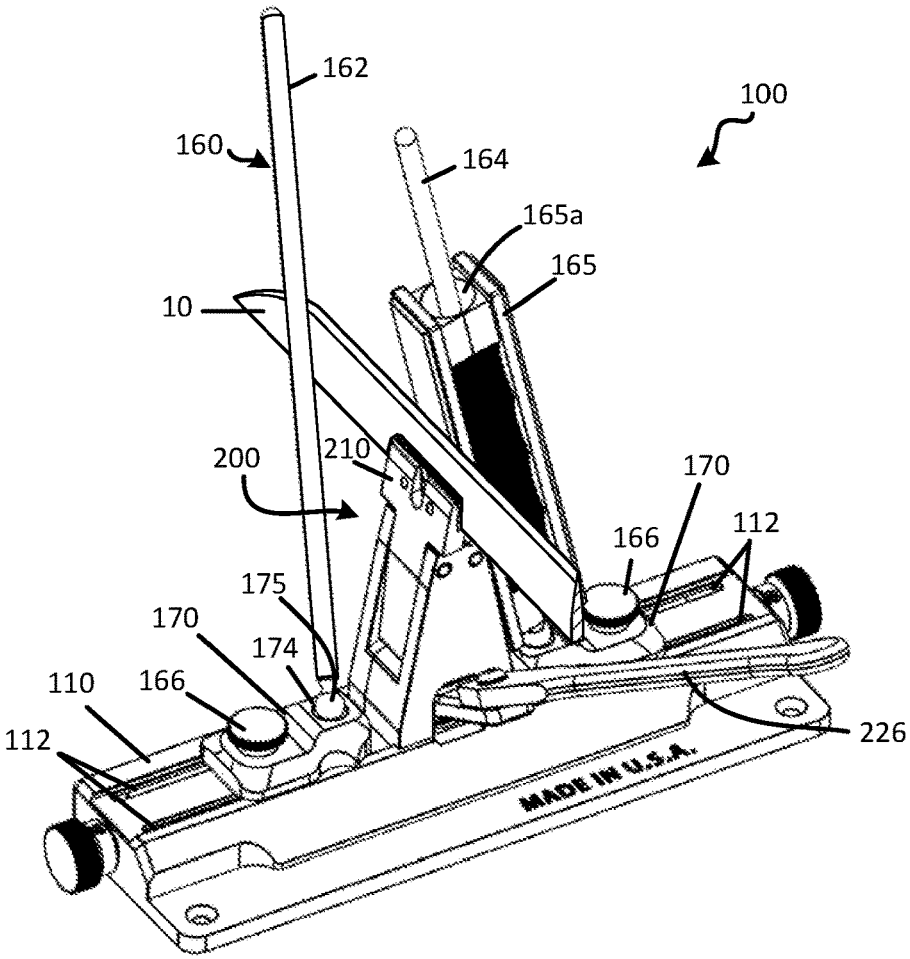
FIG. 1 is a front perspective view of a sharpening assembly that includes a base oriented in a horizontal plane, a clamping assembly with jaws extending upward from the base for engaging a workpiece, and guide rods with a hone on one of the guide rods, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a clamping assembly that includes a pair of jaws supported in opposed, spaced-apart alignment on opposite sides of a central clamp axis. Each jaw has a proximal end portion and a distal end portion, where one or both jaws are pivotable between an open position and a closed position. A wedge is movable along the central clamp axis between the proximal end portions of the jaws in response to moving a lever between a first lever position and a second lever position. In some embodiments, the wedge includes cams or rollers for engaging the inside surface of the respective jaw. The toe of the lever is coupled to the wedge by a pin. The heel of the lever is coupled by a linkage to a spring position positioned below the jaws. The spring piston enables the lever to continue to move to the second lever position after the jaws engage a workpiece.

In accordance with one embodiment, when the jaws close on a metal knife blade or other workpiece prior to the lever moving fully to the second lever position, additional movement of the lever compresses the spring piston into the base. In doing so, the heel of the lever and linkage move through a position where these components are vertically aligned along the clamp axis between the spring piston and the wedge. Moving the lever further shifts the heel past the central clamp axis so that the linkage is inclined rearward in a stable position. Accordingly, lever occupies a "locked" position that retains the jaws in engagement with the workpiece until the user releases the lever by pivoting it through the position where the heel and linkage are aligned along the central clamp axis. The clamping assembly with spring piston and linkage can reduce the force required to move the lever fully to the second lever position. Numerous variations and embodiments will be apparent in light of the present disclosure.

Overview

Some sharpening assemblies include a clamp to secure the work piece during sharpening operations. For example, the clamp may include crank that is operated to close the jaws to engage a workpiece. The crank can require many turns before the jaws engage the workpiece, particularly when used with workpieces of different thicknesses.

Other clamp assemblies include a handle operable to close the jaws. A challenge of such clamp assemblies is the need for the user to adjust the jaw spacing to accommodate work pieces of different thicknesses. The clamp may also need to be adjusted so that clamping pressure is adequate to securely hold the work piece during sharpening while also not marring the blade surface. In some cases, the clamping force may be inappropriate for a particular workpiece and can mar the finish of a knife or fail to securely hold the knife during sharpening operations. Similarly, cumbersome adjustments may discourage the user from making the necessary adjustment in the first place, leading to a poor sharpening result or frustration when using the clamp. For example, the user may need to complete an iterative process to achieve the optimal jaw spacing for each knife blade so that the jaws securely hold the blade without marring the surface.

Thus, a need exists for improvements to clamping assemblies of a knife sharpener assembly, such as a knife sharpener with a clamping assembly that adjusts to workpieces of different thicknesses. The present disclosure addresses this need and others by providing a knife sharpener with a clamping assembly where the clamping force is buffered or limited by a spring piston between the lever and the sharpener base. Numerous variations and embodiments will be apparent in light of the present disclosure.

Features disclosed herein can provide a clamp assembly that exhibits smoother and/or more controlled movement of the lever between the first and second lever positions. Other advantages will be apparent in light of the detailed description that follows.

As discussed herein, terms referencing direction, such as upward, downward, vertical, horizontal, left, right, front, back, etc., are used for convenience to describe embodiments of a clamping assembly having jaws oriented vertically and a base extending in a horizontal plane. Embodiments of a clamping assembly and sharpener in accordance with the present disclosure are not limited by these directional references and it is contemplated that the clamping assembly and sharpener could be used in any orientation.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter

EXAMPLE EMBODIMENTS

Figure 2:
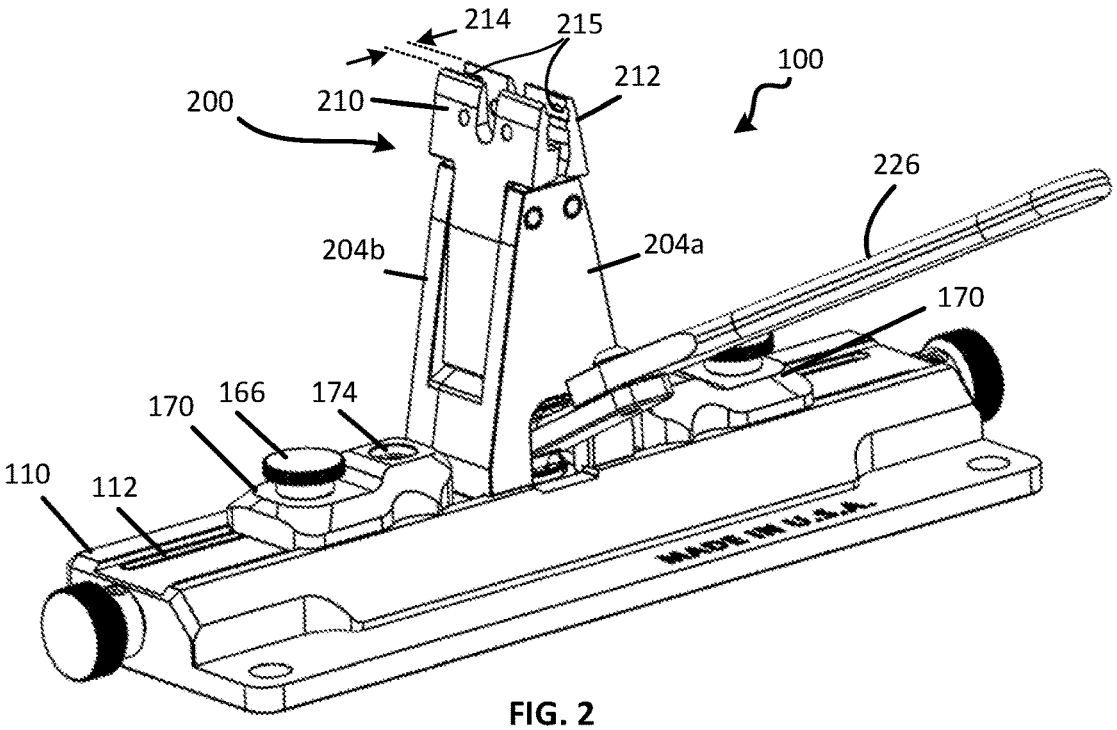
FIG. 2 illustrates a front perspective view of the sharpening assembly of FIG. 1 with the guide rods and workpiece omitted and with the lever in a first lever position, in accordance with an embodiment of the present disclosure.

FIGS. 1 and 2 illustrate a top and front perspective view of a sharpening assembly 100, in accordance with some embodiments of the present disclosure. In FIG. 2, the guide rods 162, 164, hone 165, and workpiece 10 are omitted to more clearly show components of the sharpening assembly 100 and clamping assembly 200. The sharpening assembly 100 includes a base 110, a clamping assembly 200 mounted on the base 110, and a guide rod assembly 160 movably mounted on the base 110.

In this example, the clamping assembly 200 is shown in an open position with the lever 226 in a first lever position (upward position) and jaws 210, 212 open and spaced by a gap 214. In FIG. 1, a workpiece 10 is placed loosely in the gap 214 between the open jaws 210, 212 to illustrate an example position of the workpiece 10 during sharpening operations. As can be seen in FIG. 2, the inside surface of each jaw 210, 212 includes a plurality of individual teeth or gripping surfaces 215 at the front and rear portions of the jaw. For example, the front portion of each jaw 210, 212 has two vertically spaced gripping surfaces 215, each of which is oriented horizontally. The rear portion of each jaw 210, 212 has one gripping surface 215 oriented horizontally and having a vertical position between that of the two gripping surfaces 215 at the front of the jaw. The gripping surfaces 215 can be oriented horizontally (e.g., parallel to an elongated workpiece 10), vertically, or have some other orientation. Operating the lever 226 moves the jaws 210, 212 between open and closed positions, as will be discussed in more detail below. In some embodiments, the gripping surfaces 215 can better apply clamping forces to a blade of changing geometry to more securely hold the blade, compared to jaws without the gripping surfaces 215.

The guide rod assembly 160 includes a first guide rod 162 and a second guide rod 164, each of which is pivotably connected to a rod mount 170 attached to the base 110. In some embodiments, the rod mount 170 may be referred to as a slider or bracket. As shown in FIG. 1, each guide rod 162, 164 is coupled to the rod mount 170 via receptacle 174. The end of each guide rod 162, 164 defines a ball 175 that is received in a hemispherical, concave, or otherwise recessed socket or receptacle 174. The receptacle 174 can include a permanent magnet and the ball 175 can be made of or include a ferromagnetic material, such as steel or a second permanent magnet. The recessed shape of the receptacle 174 and magnetic attraction retains the ball 175 in the receptacle 174 so that the rod 162, 164 can be rotated about its axis and can be pivoted about the ball 175 as desired. In some embodiments, the receptacle 174 optionally can include a polymer gasket, O-ring, or low-friction material (e.g., a PTFE coating) between the ball 175 and the receptacle 174 to facilitate smooth movement of the ball on the bearing surface of the receptacle 174. In some embodiments, the receptacle 174 is configured as a ball-and-socket joint.

In one embodiment, each rod mount 170 can be secured using a fastener 166 to the base 110 along one or more slots 112 that extend laterally on both sides of the clamping assembly 200. For example, each rod mount 170 can be positioned along the respective slots 112 and then secured in place by tightening the fastener 166 to draw the rod mount 170 tight against the base 110. Accordingly, each guide rod 162, 164 can be selectively positioned on opposite lateral sides of the clamping assembly 200 to guide a hone 165 in a reciprocal motion along each guide rod 162, 164 to sharpen a workpiece 10 (e.g., a knife) retained in the jaws of the clamping assembly 200. Using this approach, a sharpening angle between the hone 165 and the workpiece 10 can be adjusted as desired for a particular workpiece 10. Note that only one hone 165 is shown in this example but it will be appreciated that each guide rod 162, 164 can include a hone 165, in some embodiments. Similarly, while two guide rods 162, 164 and two rod mounts 170 are shown, this is not required in all embodiments and the sharpening assembly 100 may have a single guide rod 162 and a single rod mount 170 that can be selectively installed on either side of the jaws 210, 212 as needed.

The hone 165 is configured to slide along each guide rod 162, 164 via a longitudinal opening 165*a* that extends through the hone 165 from end to end. In one embodiment, the hone 165 generally has a rectangular cross-sectional shape and includes an abrasive material on one or more of the hone 165 faces. The abrasive or honing material may take any of a number of forms and can vary from a coarse grit to a fine grit (for example, 50 to 15000 grit).

Figure 3:
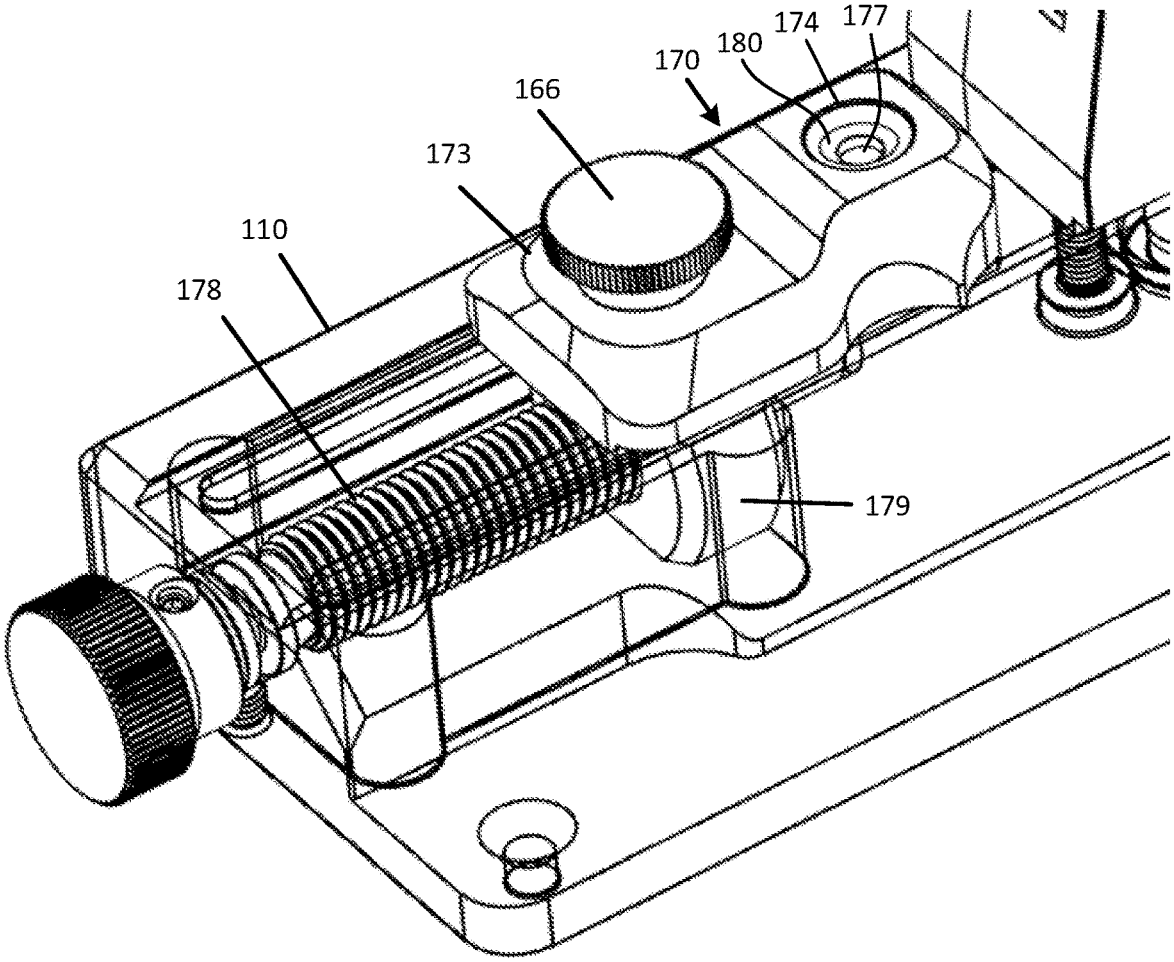
FIG. 3 is a top perspective view of an adjustable mount for a guide rod, where portions of the base are illustrated as transparent, in accordance with another embodiment of the present disclosure.
Figure 4:
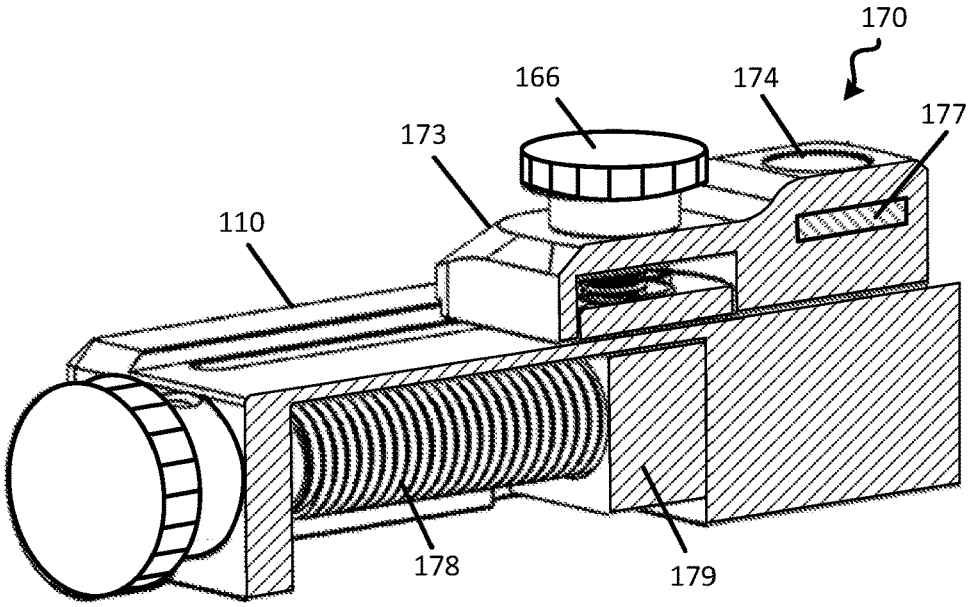
FIG. 4 is a front perspective and cross-sectional view of an adjustable mounting assembly for a guide rods, in accordance with an embodiment of the present disclosure.

Referring now to FIGS. 3 and 4, a top perspective view and a perspective, cross-sectional view, respectively, show a portion of the base 110 and rod mount 170 for first guide rod 162 (shown in FIG. 1), in accordance with an embodiment of the present disclosure. The rod mount 170 for the second guide rod 164 can be identical to or can be a mirror image of the example shown. In this example, the rod mount 170 has a mount base 173 that includes or defines the receptacle 174. In this example, the rod mount 170 has a recessed receptacle 174 sized to receive the ball 175 (shown in FIG. 1) on the first guide rod 162. Note that the ball 175 can be integrally formed as part of the guide rod 162 or part of a connector attached to the guide rod 162. In some embodiments, the receptacle 174 is concave and is magnetized to retain the ball 175. For example, the receptacle 174 is made of or includes a permanent magnet 177. In one such embodiment, the magnet 177 has a planar bearing surface that contacts the ball 175. In some embodiments, an annular body or spacer 180 is between the magnet and the ball 175, where a radially inner surface of the spacer 180 provides a circular contact with the ball 175. For example, the spacer 180 can be a washer, O-ring, ring, bearing, or like structure. The spacer 180 can be made of metal (e.g., steel), plastic, or pliable polymer. The spacer 180 can reduce wear on the ball 175 as well as limit collection of debris, in accordance with some embodiments.

The mount base 173 is laterally movable along the base 110 by rotating a lead screw 178. In the example shown, the lead screw 178 extends horizontally into an end of the base 110 below the guide rod assembly 160 and engages a block 179 or equivalent structure secured to the bottom of the mount base 173. The lead screw 178 is retained in the base 110 such that the lateral position of the lead screw 178 does not change as the lead screw 178 is rotated. As such, rotating the lead screw 178 threadably engages the block 179 to move the guide rod assembly 160 linearly along the base 110 in a first lateral direction (e.g., towards the clamping assembly 200). As the lead screw 178 is rotated in an opposite second direction, the guide rod assembly 160 moves linearly along the base 110 in an opposite second lateral direction (e.g., away from the clamping assembly 200). In doing so, the base 173 of the rod mount 170 moves along the top surface of the base 110. Thus, the lead screw 178 can be used to adjust the position of the guide rod assembly 160, and therefore define the sharpening angle between the hone 165 and the work piece 10 (shown in FIG. 1). As shown in this example, the mount base 173 is a separate component from the block 179 and can be attached to the block 179 with a fastener 181 (shown in FIG. 6). Fastener 166 can be advanced to tighten the mount base 173 against the base 110 and fix its position.

Figure 5:
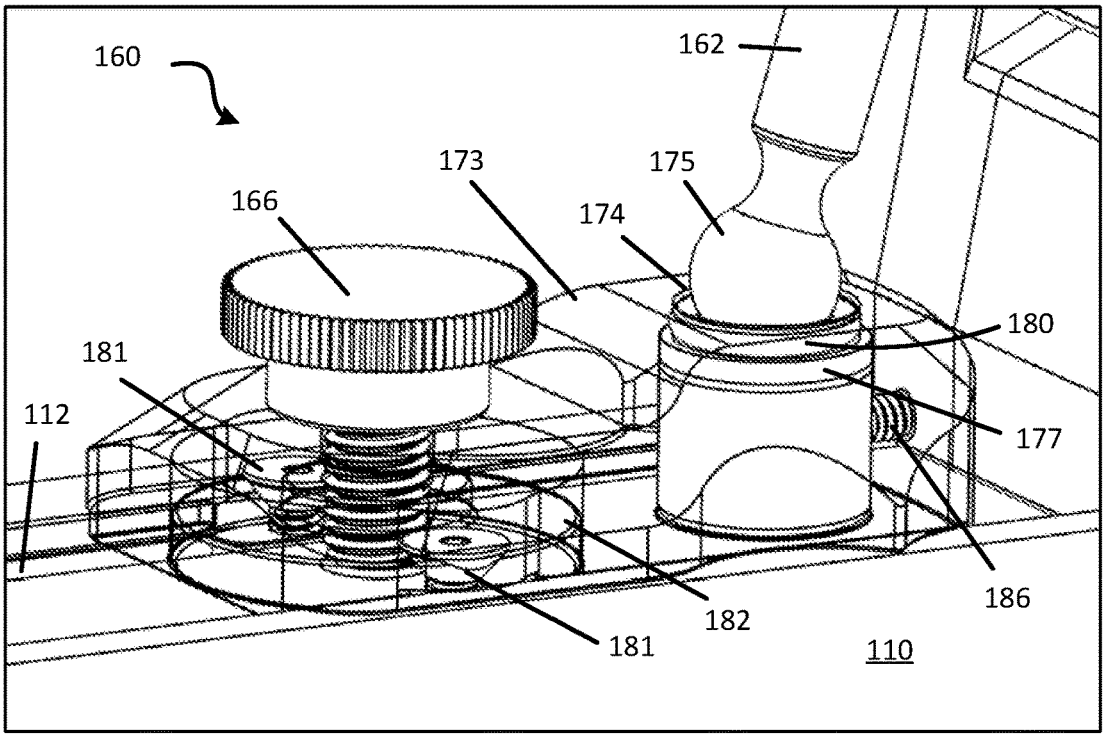
FIG. 5 is a front perspective view of a magnetic mounting assembly for a guide rod, where parts of the mount body is illustrated as transparent, in accordance with an embodiment of the present disclosure.
Figure 6:
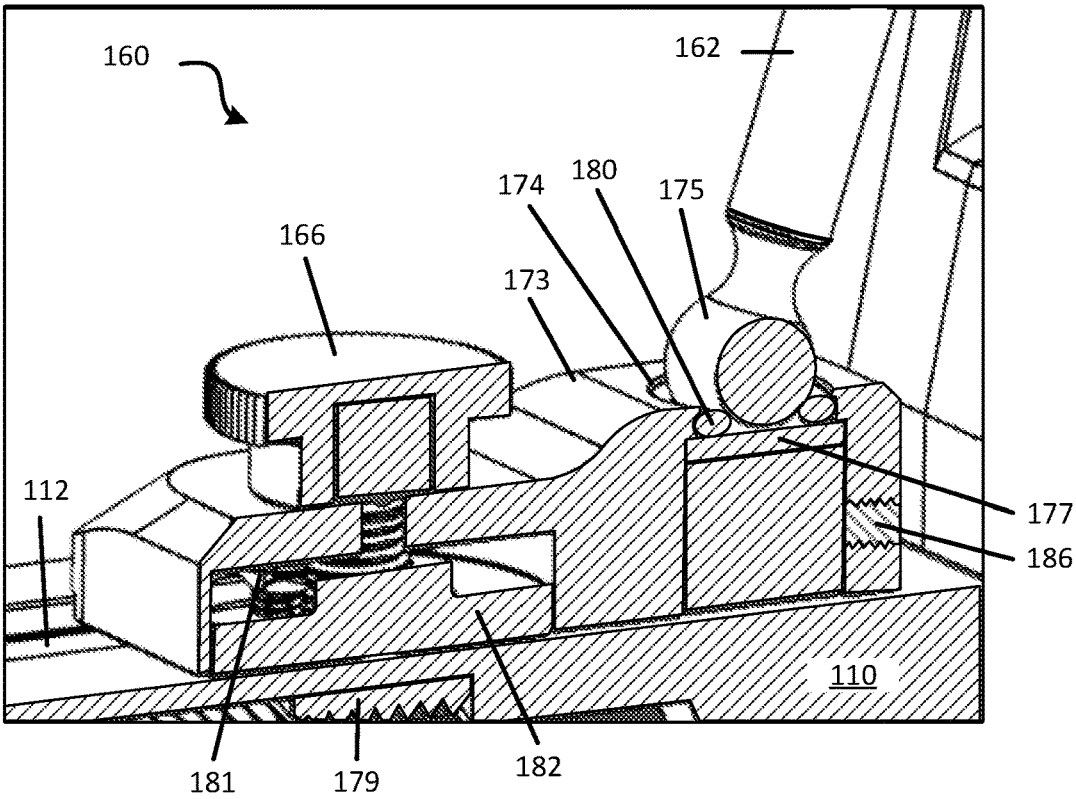
FIG. 6 is a front perspective and cross-sectional view of the magnetic mounting assembly of FIG. 5, in accordance with an embodiment of the present disclosure.

Referring now to FIGS. 5 and 6, a transparent, front perspective view and a cross-sectional view, respectively, illustrate portions of a guide rod assembly 160, in accordance with an embodiment of the present disclosure. In this example, the receptacle 174 has a cup-like shape that receives the ball 175 of the guide rod 162 on a planar bearing surface, such as the top surface of magnet 177. Optionally, a low-friction material, such as a PTFE coating or the like, can be on the top of the magnet 177 and define the bearing surface. The magnet 177 in the receptacle 174 retains the ball 175 in the receptacle 174 via magnetic attraction. A washer or O-ring spacer 180 on top of the magnet 177 partly defines the bounds of the receptacle 174. A set screw 186 can be used to fix the magnet 177 or magnet assembly in the mount base 173. Fasteners 181 extend vertically through the mount base 173 and into the block 179 (shown in FIGS. 3-4). As can be seen in FIG. 6, the mount base 173 can be clamped to the base 110 using a flanged nut 182 that is received in the bottom of the mount base 173. The nut 182 is engaged by fastener 166 extending through the top of the mount base 173 and can be tightened to secure the position of the mount base 173. Additional fasteners 181 extend through the flanged nut 182 and slots 112 in the base 110 to connect to the block 179. The fastener 166 can be advanced or retracted to apply pressure between the flanged nut 182 and base 110 as needed to fix the position of the mount base 173.

Figure 7:
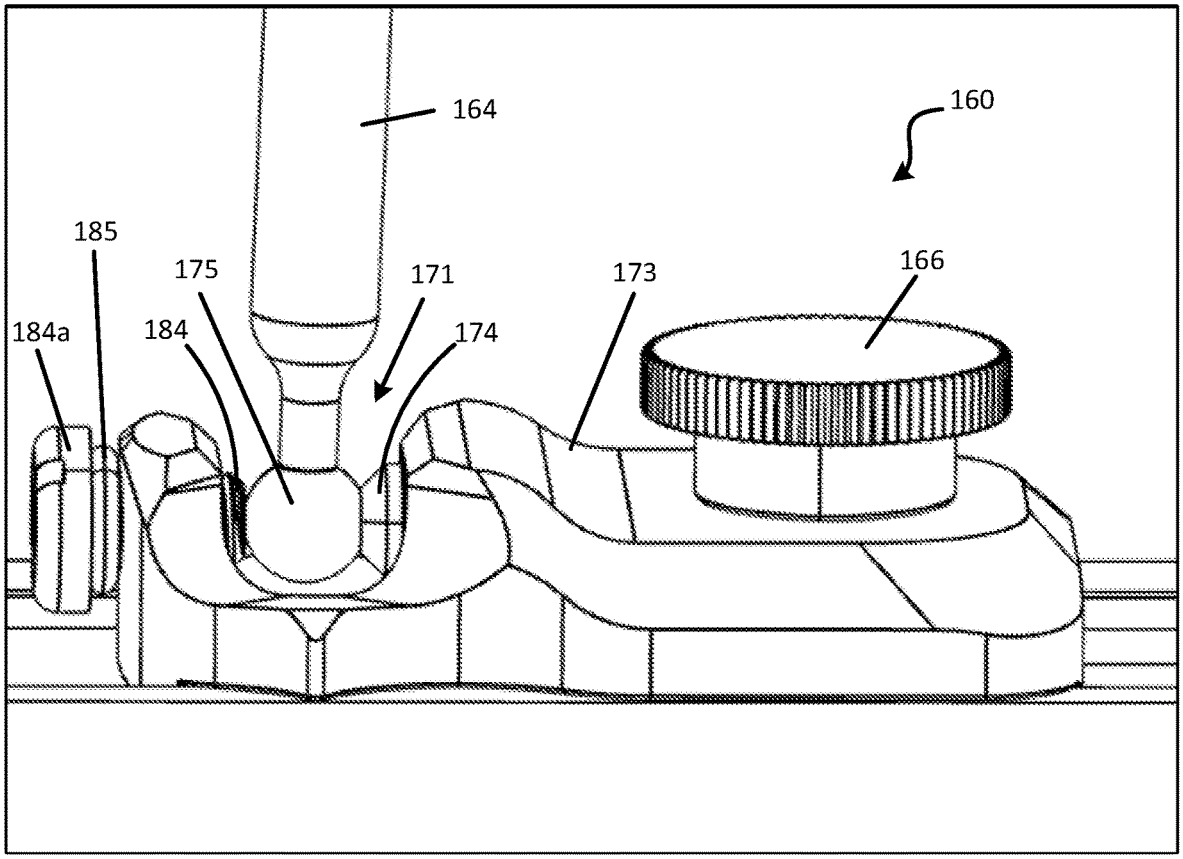
FIG. 7 is a front view of a mounting assembly for a guide rod, in accordance with another embodiment of the present disclosure.
Figure 8:
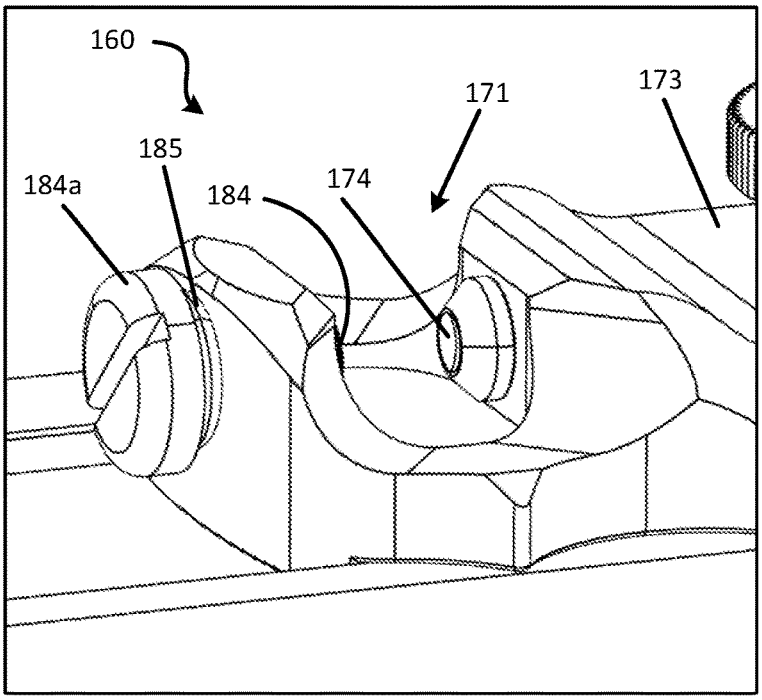
FIG. 8 is a front perspective view of the mounting assembly of FIG. 7 shown without the guide rod, in accordance with an embodiment of the present disclosure.

Referring now to FIGS. 7 and 8, front perspective views illustrate portions of a guide rod assembly 160 and second guide rod 164, in accordance with another embodiment of the present disclosure. In FIG. 8, the second guide rod 164 is omitted to more clearly show features of the mount base 173. In this example, the second guide rod 164 defines a ball 175 on one end. The mount base 173 defines a gap or opening 171 sized to receive the ball 175 as well as to permit the guide rod 164 to pivot about the ball 175. A concave receptacle 174 is on one lateral face of the opening 171. A fastener 184 extends through the opposite lateral face of the opening 171 towards the receptacle 174. The ball 175 is captured between the concave receptacle 174 and an end of the fastener 184. Optionally, the end of the fastener 184 can be conical or concave that is sized to receive or having a curvature consistent with that of the ball 175. The fastener 184 can be tightened as needed to retain the ball 175 in the concave receptacle 174. When installed, the ball 175 and concave shape of the receptacle 174 permits the rod 164 to pivot and rotate about the ball 175. Optionally, an elastomeric O-ring 185 is between the head 184*a* of the fastener 184 and the mount base 173 to prevent the fastener 184 from backing out of the screw opening.

Figure 9:
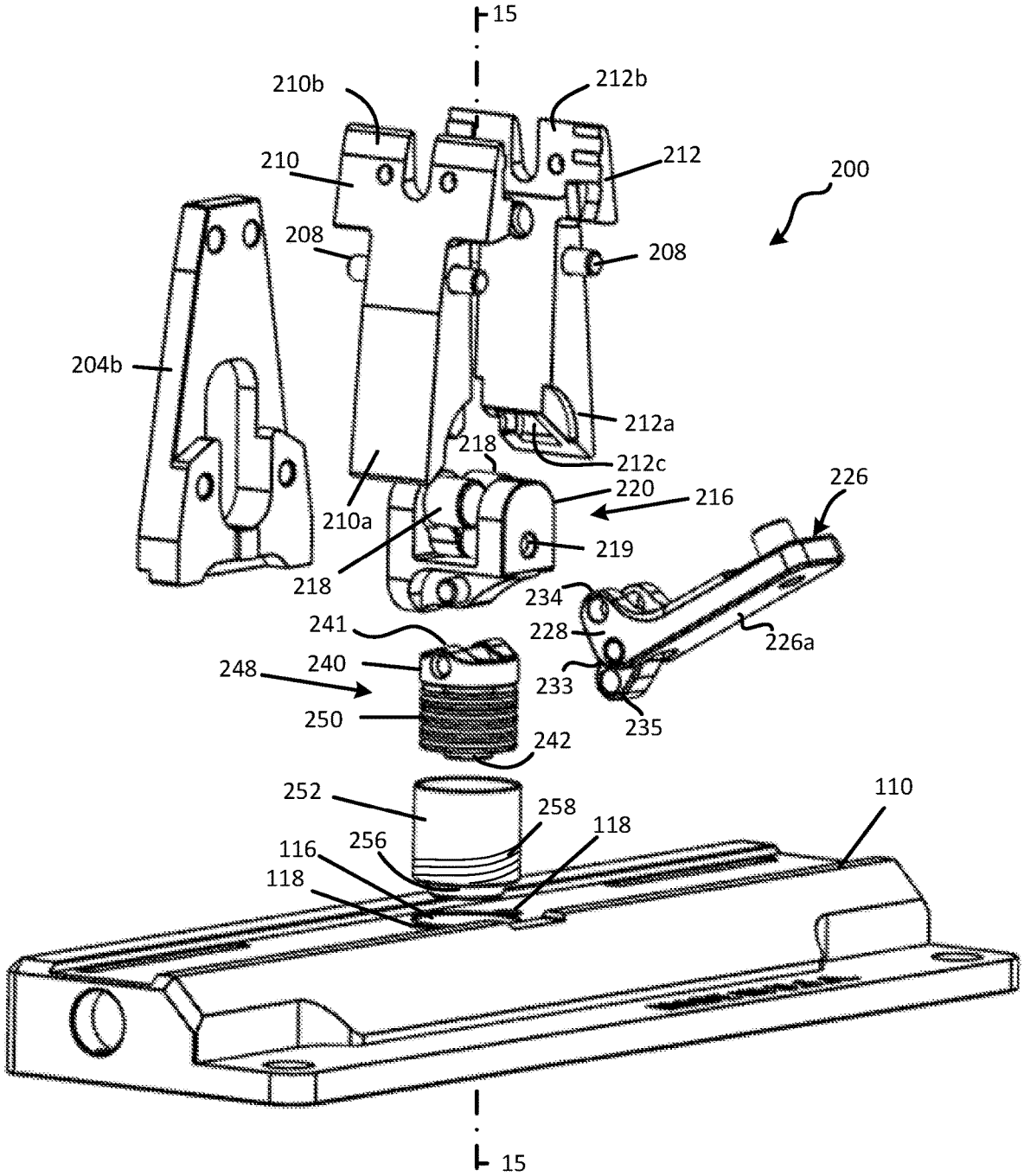
FIG. 9 illustrates an exploded, front, perspective view showing components of a sharpening assembly, in accordance with an embodiment of the present disclosure.

FIG. 9 illustrates an exploded, front perspective view showing components of the clamping assembly 200, in accordance with an embodiment of the present disclosure. The base 110 is positioned below the clamping assembly 200 and is oriented in a horizontal plane. The base 110 defines a spring well 116 that extends into or through the base 110 along the central clamp axis 15, which extends vertically through the top surface of the base 110 in this example. The spring well 116 can be a circular bore or have some other shape suitable to receive a spring piston 248 that includes one or more springs 250 and a spring plate or piston body 240. Adjacent the spring well 116 are fastener openings 118 extending through the base 110 in a direction that is parallel to the central clamp axis 15. Fasteners can be installed through each fastener opening 118 and into an end (e.g., bottom end) of the clamp housing 204 to secure the housing 204 to the base 110. In this example, the housing 140 includes a front housing portion 204*a* (shown in FIG. 2) and a rear housing portion 204*b* that can be secured to the base 110 using fasteners that extend through fastener openings 118 and into the bottom end of the front housing portion 204*a*. The rear housing portion 204*b* can be secured to the base 110 or can be secured to the front housing portion 204*a* with fasteners that extend horizontally between the front and rear housing portions 204*a*, 204*b*. Jaws 210, 212 are pivotably retained between the front housing portion 204*a* and rear housing portion 204*b* by pins 208.

The clamping assembly 200 includes a first jaw 210 and a second jaw 212 each generally oriented along the central clamp axis 15. One or both of the first and second jaws 210, 212 are pivotably supported over the base 110 by the clamp housing 204. In this example, the central clamp axis 15 is a vertical axis passing between the jaws 210, 212 and through a spring piston 248. The first jaw 210 has a proximal end portion 210*a*, a distal end portion 210*b*, and an inside surface 210*c*. The second jaw 212 similarly has a proximal end portion 212*a*, a distal end portion 212*b*, and an inside surface 212*c*. The second jaw 212 is positioned in opposed alignment with the first jaw 210 so that the inside surface 212*c* of the second jaw 212 faces and is spaced apart from the inside surface 210*c* of the first jaw 210.

Each of the first and second jaws 210, 212 can be pivotably mounted between the front housing portion 204*a* and rear housing portion 204*b* using one or more pins 208. In this example, each of the front housing portion 204*a* and rear housing portion 204*b* includes a plate extending away from the base 110 (e.g., a vertical plate extending upward from the base 110), where the front housing portion 204*a* and rear housing portion 204*b* are spaced apart to receive portions of the jaws 210, 212 between them. Pins 208 connecting the first and second jaws 210, 212 to the clamp housing 204 allow the jaws 210, 212 to pivot or rotate about the respective pin 208. Thus, each of the first jaw 210 and second jaw 212 can pivot about pin(s) 208 between an open position and a closed position to clamp a work piece 10 between the distal end portions 210*b*, 212*b*. In one embodiment, the pin(s) 208 connecting each jaw 210, 212 to the clamp housing 204 is positioned along the jaw 210, 212 so that a greater mass of the proximal end portion 210*a*, 212*a* biases the jaws 210, 212 towards the open position when the jaws 210, 212 are oriented vertically. In other embodiments, a spring can be used to bias the jaws 210, 212 to the open position. In other embodiments, one of the first or second jaws 210, 212 has a fixed position and the other of the first or second jaws 210, 212 pivots between the open and clamped positions.

A cam assembly 216 is positioned for movable engagement with the inside surfaces of the proximal end portions 210*a*, 212*a* of the first and second jaws 210, 212, respectively. In embodiments where only one of the jaws 210, 212 pivots, the cam assembly 216 can be positioned to operate the pivoting jaw, as will be appreciated. In the assembled state, the cam assembly 216 is positioned between the proximal end portions 210*a*, 212*a* of the jaws 210, 212 such that the cam assembly 216 can be advanced between the proximal end portions 210*a*, 212*a* along the central clamp axis 15. In doing so, the cam assembly 216 functions as a wedge to spread apart the proximal end portions 210*a*, 212*a* and cause the distal end portions 210*b*, 212*b* to pivot toward the closed position. For example, advancing the cam assembly 216 between the proximal end portions 210*a*, 212*a* along the central clamp axis 15 forces apart the proximal end portions 210*a*, 212*a* and causes the distal end portions 210*b*, 212*b* to pivot towards each other.

In some embodiments, the cam assembly 216 can include a carrier or yoke 220 with one or more cams 218 retained by the yoke 220, where each cam 218 is configured to movingly engage the inside surface along the proximal end portions 210*a*, 212*a* of jaws 210, 212. In this example, the cam assembly 216 includes two cams 218, each of which is pivotably attached to the yoke 220 by a pin 219. In some embodiments, each cam 218 can be a roller, a rounded surface that slidingly engages the inside surface of the jaws 210, 212, a block, or some other suitable structure. For example, each cam 218 has a polished metal finish such as anodized aluminum. In this example, the cam assembly 216 includes a pair of cams 218, each of which has a rounded surface positioned to engage one of the respective inside surfaces of the first and second jaws 210, 212. In this example, the cams 218 are retained in a yoke 220 so that each cam 218 can rotate independently of the other as it travels along the respective inside surface 210*c*, 212*c* of the first or second jaws 210, 212. The yoke 220 is operatively connected to the lever 226 such that the yoke 220 moves along the central clamp axis 15 when the lever is pivoted between the first lever position (e.g., upward) and second lever position (e.g., approximately horizontal). In some embodiments, the cam assembly 216 can be a wedge, block, or the like that is configured to advance between the jaws.

A spring piston 248 is received in a spring well 116 in the base 110 and includes a piston body 240 positioned approximately at the top surface of the base 110. For example, the piston body 240 is on top of a spring 250 that is received in the spring well 116. The spring piston 248 can include one or more of a helical coil spring, a disc spring (e.g., a Belleville washer), a polymer spring, a wave spring, a leaf spring, or other suitable spring. The piston body 240 is coupled to the proximal end portion of the lever 216, such as at the heel 233, so that the lever 226 pivots against the piston body 240 to advance the cam assembly 216 upward between the jaws 210, 212. The piston body 240 optionally includes a post 242 extending from its bottom surface into the spring 250. In some embodiments, the post 242 has an axial length about equal to or less than a solid height of the spring 250, although this is not required in all embodiments.

The top of the spring piston can define a sloped or domed cam surface 241 that engages the heel 233 of the lever 226 as the lever 226 pivots towards the second position. In one such embodiment, the cam surface 241 has a parabolic shape with lateral portions on each side of the linkage 235. As the lever 226 pivots downward, for example, the heel 233 is drawn inward and over the parabolic cam surface 241, causing the cam assembly 216 to rise between the jaws 210, 212. In doing so, the linkage 235 stabilizes the heel 233 and guides its path along the cam surface 241 while also restricting lateral or rotational movement of the heel 233.

Optionally, the spring piston 248 is received in a receptacle 252 that in turn is received in the spring well 116. In one embodiment, the receptacle 252 has a hollow cylindrical shape and including a receptacle base 256 of reduced diameter at its bottom. In one embodiment, the receptacle base 256 is configured to receive the post 242 extending down from the piston body 240 and through the spring 250. In some embodiments, the post 242 can have an axial dimension that is equal to or less than the solid height of the spring 250. In other embodiments, the post 242 is greater in axial length than the axial dimension of the spring 250 in its resting position, which facilitates centering the spring 250 with the piston body 240. For example, when the spring 250 compresses, the post 242 may extend beyond the spring 250 and into the base 110.

The lever 226 has a proximal lever end portion 228 that is operatively connected to the cam assembly 216 and to the piston body 240. In this example, the proximal lever end portion 228 defines an L-shape, or functional equivalent, with a toe 234 extending transversely away from the elongated lever body 226*a*. The proximal lever end portion 228 defines a heel 233 at a corner or turn between the elongated lever body 226*a* and the toe 234. The toe 234 is pivotably connected to the cam assembly 216 by a pin or fastener. The heel 233 is pivotably connected to the piston body 240 by a linkage 235. The linkage 235 permits the heel 233 to move towards or away from the central clamp axis 15 as the toe 234 moves axially with the cam assembly during operation of the lever 226. When the jaws 210, 212 reach the closed position (e.g., upon engaging a metal workpiece), moving the lever 226 further to the second lever position causes the heel 233 to move towards the central clamp axis 15, aligning the linkage 235, toe 234, and heel 233 along the central axis 15. In this lever position, the piston body 240 has its greatest axial spacing from the cam assembly 216.

In some embodiments, the lever 226 and linkage 235 attain a position of maximum extension between the piston body 240 and the cam assembly 216 during movement of the lever 226 to the second lever position. In some embodiments, the position of maximum extension occurs when the heel 233 is atop the parabolic cam surface 241. In this position, the linkage 235, toe 234, and heel 233 are aligned along the central clamp axis 15 between the cam assembly 216 and piston body 240. In the position of maximum extension, the pin connecting the toe 234 to the yoke 220, the pin connecting the linkage 235 to the heel 233, and the pin connecting the linkage 235 to the piston body 240 are vertically aligned along the central clamp axis. The lever 226 can be pivoted further to the second lever position in some embodiments so that the heel 233 and part of the linkage 235 cross the central clamp axis 15 to a position of lower energy compared to the position of maximum extension. In this lower energy position, the lever 226 can be perceived to "lock" the jaws in a clamped position with the linkage 235 no longer being vertically aligned along the central clamp axis 15. In this lower energy position or "locked" position, the lever 226 requires some force in order to move the lever 226 and linkage 235 back to the position of maximum extension (a higher energy position) prior to moving the lever 226 to the first lever position (e.g., an unclamped or open position). During the movement of the lever 226 between the first and second lever positions, including moving through the position of maximum extension, the linkage 235 can provide a smoother and/or easier lever movement compared to a heel 233 that rolls or slides along a cam on the top of the piston body 240 and which exhibits increased friction when the jaws 210, 212 engage the workpiece 10.

As shown in the example of FIG. 9, the toe 234 extends transversely (e.g., perpendicularly) from the lever body 226*a*. Here, the lever 226 is oriented so that the elongated lever body 226*a* extends forward of the central clamp axis 15 with the toe 234 extending generally upward from the lever body 226*a* to the cam assembly 216 when the lever 226 is in the first lever position. The toe 234 can be connected to the cam assembly 216 with a pin or fastener. Pivoting the lever 226 from the first lever position (e.g., a generally upright or upward inclined position) to the second lever position (e.g., a generally horizontal position or slight downward incline) moves the heel 233 inward towards the central clamp axis 15 and directly below the jaws 210, 212. This also moves the toe 234 and yoke 220 axially (e.g., upward) between the jaws 210, 212, closing them. In addition, movement of the lever 226 from the first lever position to the second lever position includes moving the linkage 235 to an axial (e.g., vertical) position along the central clamp axis 15 between the piston body 240 and the yoke 220. In more detail, the proximal lever end portion 228 pivots from a position where it is inclined towards the central clamp axis 15 at an angle of about 30-45° with respect to the horizontal, to a generally axial position (e.g., a vertical position along central clamp axis 15), thereby increasing the distance between the piston body 240 and the yoke 220. In the first lever position, the heel 233 is positioned forward of the central clamp axis 15. Thus, in addition to advancing the cam assembly 216 between the jaws 210, 212, moving the lever 226 from the first lever position to the second lever position moves the heel 233 rearward. Prior to the jaws engaging a workpiece 10, the position of the piston body 240 may remain substantially unchanged while the jaws pivot towards the closed position. When the jaws engage an incompressible workpiece 10, for example, force is transferred to the spring piston 248 as the lever 226 continues to move towards the second lever position, compressing the spring 250 and pivoting the linkage 235 towards its axial (vertical) position between the heel 233 and the piston body 240.

In use, moving the lever 226 from the first lever position to the second lever position moves the cam assembly 216 along the central clamp axis 15 between and in engagement with the proximal end portions 210*a*, 212*a* of the first and second jaws 210, 212, thereby pivoting the distal end portions 210*b*, 212*b* to a closed or clamped position. Similarly, moving the lever 226 from the second lever position (e.g., clamped) to the first lever position (e.g., open or unclamped position) moves the cam assembly 216 in an opposite direction (e.g., down) along the central clamp axis 15, thereby allowing the distal end portions 210*b*, 212*b* of the jaws 210, 212 to assume an open position.

The spring piston 248 takes up additional movement of the lever 226 when moving to the second lever position after the first and second jaws 210, 212 engage the work piece 10. In the second lever position, which may be referred to as a locked position, the lever 226 and linkage 235 occupy a stable position where the linkage 235 is inclined upward and rearward away from the lever 226. From this position, the user must apply some force to the lever 226 to return the linkage 235 to a vertical position, further compressing the spring piston 248, before moving the lever 226 to the first lever position.

For example, the lever extends forward and slightly downward when in the second lever position. From here, the user can pivot the lever 226 slightly upward to a horizontal position to move the linkage 235 and proximal lever end portion 228 through a true axial position (e.g., vertical position) that further compress the spring piston 248 compared to when the lever 226 is in the "locked" or second lever position. From the intermediate horizontal lever position, the user can then move the lever 226 further upward to the first lever position, disengaging the jaws from the workpiece.

For a given gap 214 between the distal end portions 210*b*, 212*b*, the first and second jaws 210, 212 will engage a particular work piece 10 at a corresponding position of the lever 226 and axial position of the yoke 220 along the central clamp axis 15. The position of the lever 226 when the jaws 210, 212 engage the workpiece 10 can be adjusted in some embodiments. Typically, it is desired for the first and second jaws 210, 212 to engage the work piece 10 before the lever 226 is moved fully to the second lever position, but preferably not at the beginning of this movement from the first lever position.

In some embodiments, the spring well 116 and outside surface of the receptacle 252 include threads 258 so that the receptacle 252 is threaded into the spring well 116. Accordingly, the axial position of the receptacle 252 in the spring well 116 can be adjusted by rotating the receptacle 252 to raise or lower its position with respect to the base 110. By advancing or retracting the receptacle 252 in the spring well 116, the receptacle 252 can be moved up or down along the central clamp axis 15 to adjust the clamping force by changing the axial distance between the piston body 240 and the proximal end portions 210*a*, 212*a* of the first and second jaws 210, 212, and therefore the amount of spring compression when the lever 226 is in the second lever position. As such, the clamping force and/or gap 214 between the distal end portions 210*b*, 212*b* can be adjusted. The axial position of the receptacle 252 (or spring piston 248 by itself) can also be adjusted by rotating a threaded fastener into or away from the bottom of the receptacle 252 (or a base of the spring piston 248) to change the axial distance from the spring piston to the jaws 210, 212. Further, the axial position of the spring piston 248 can be adjusted in other embodiments by the use of one or more spacers (e.g., a washer or disk) in the bottom of the spring well 116. By adding or removing spacers, the axial position of the spring piston 248 is adjusted, thereby adjusting the clamping force and/or the gap 214 between the open jaws 210, 212. Using one or more of these techniques, the gripping force of the clamping assembly 200 can be adjusted to require more or less spring compression when the lever 226 is in the second lever position.

In one example, where the clamping assembly 200 is used predominantly with small knives, the vertical position of the spring piston 248 can be adjusted to be closer to the jaws 210, 212. This adjustment may reduce the gap 214 between the jaws 210, 212 in the open position and/or may increase the clamping force when the lever 226 is in the second lever position. For example, rotating the threaded receptacle 252 moves the receptacle 252 and spring piston 248 along the central clamp axis 15 towards (e.g. upward) the first and second jaws 210, 212. Similarly, the clamping assembly 200 can be adjusted for predominant use with thicker knives by threading the receptacle 252 downward into the spring well 116 and therefore moving the spring piston 248 away from the jaws 210, 212. This adjustment may increase the gap 214 between the distal end portions 210*b*, 212*b* of the jaws in the open position for thicker blades and/or reduces the clamping force.

Figure 10:
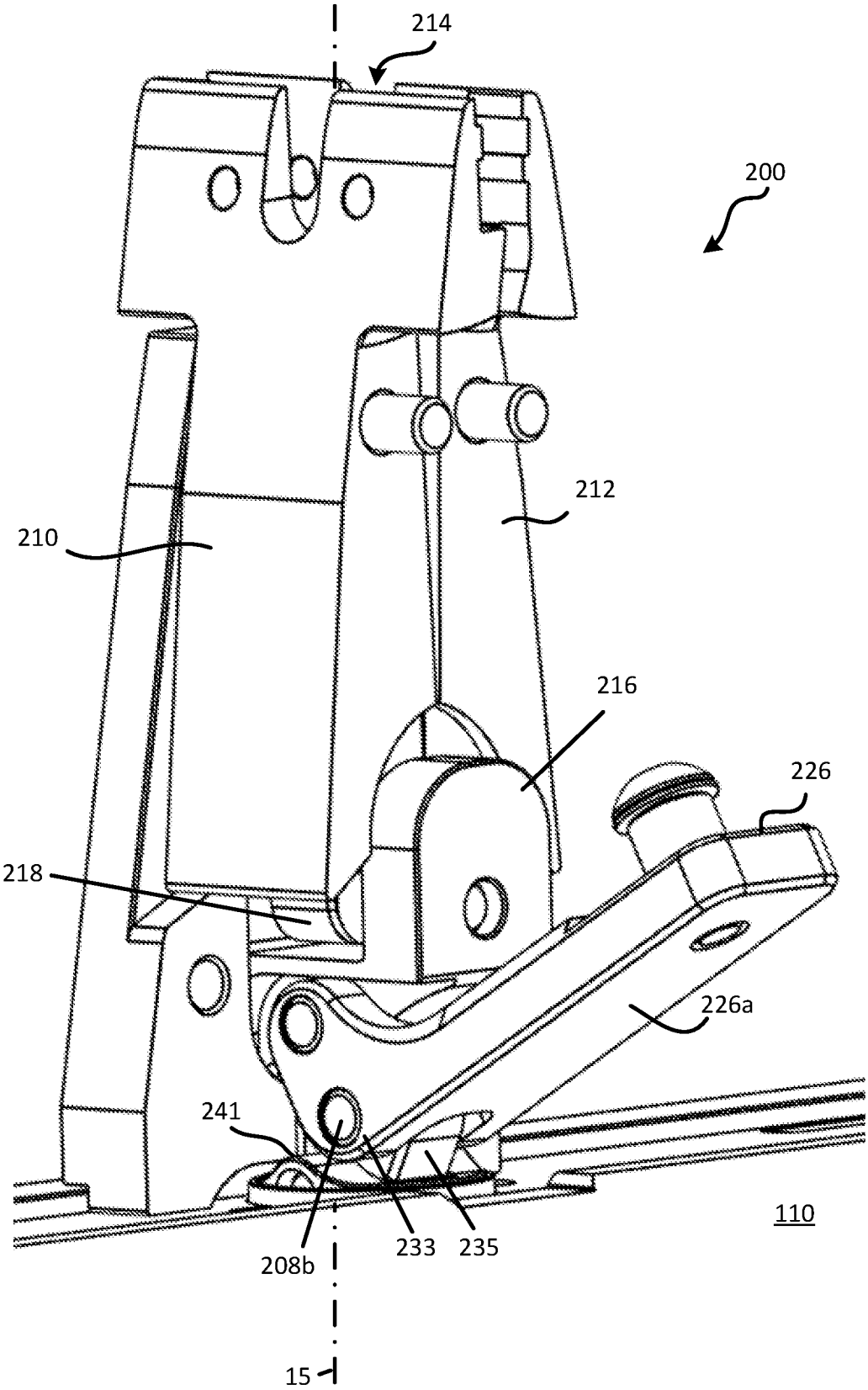
FIG. 10 illustrates a front perspective view of part of a clamping assembly with the lever in a first lever position and jaws in an open position, in accordance with an embodiment of the present disclosure.
Figure 11:
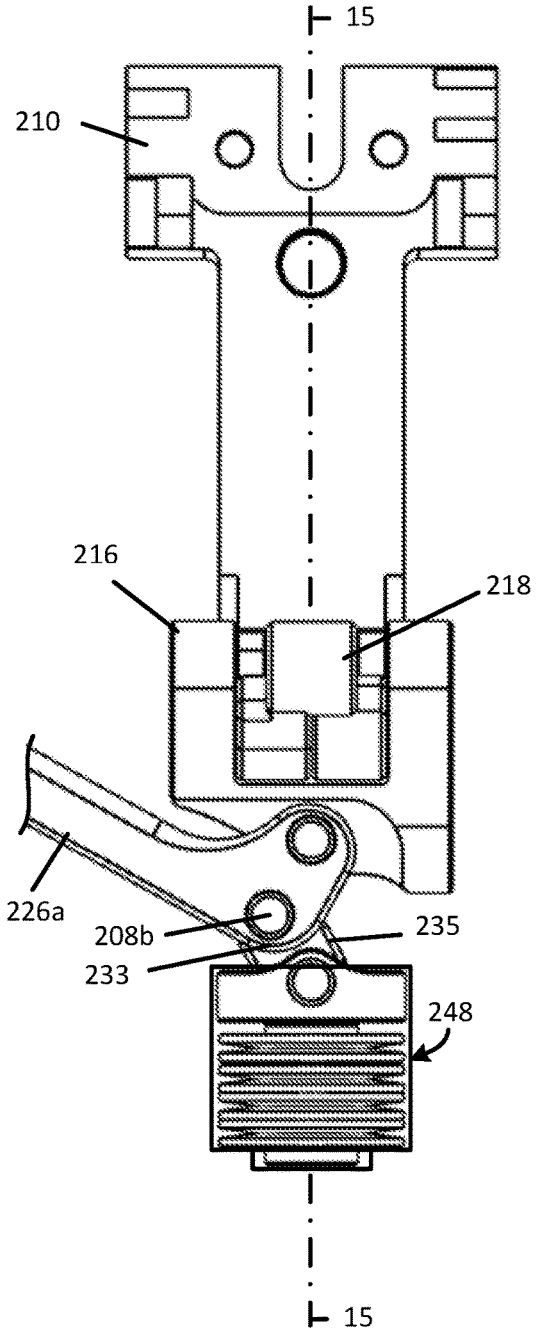
FIG. 11 illustrates a side view of part of a clamping assembly with the lever in a first lever position, in accordance with an embodiment of the present disclosure.
Figure 12:
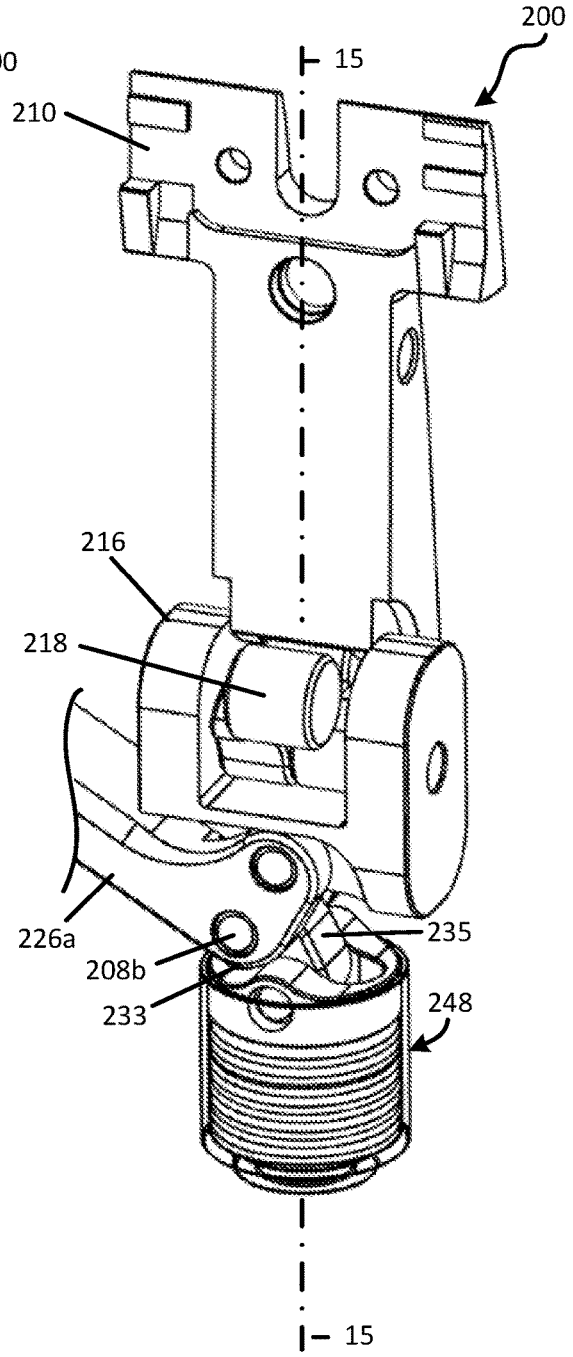
FIG. 12 illustrates a perspective view of the assembly shown in FIG. 11.

Referring now to FIGS. 10-12 various views show the clamping assembly 200 with jaws 210, 212 in an open or unclamped position and with lever 226 in a first lever position, in accordance with an embodiment of the present disclosure. FIG. 10 illustrates a front perspective view with the front housing portion 204*a* omitted to more clearly show components of the assembly. FIG. 11 shows a side view of a clamping assembly 200 with the clamp housing 204 and second jaw 212 omitted. FIG. 12 illustrates a side and rear perspective view of the assembly shown in FIG. 11.

In these examples, the lever 226 is in the first lever position where it is inclined upward and forward relative to the base 110. As noted above, the central clamp axis 15 extends through a center of the spring piston 248 and is centered between jaws 210, 212. Note that the pin 208*b* through the heel 233 is positioned forward of the central clamp axis 15 and the linkage 235 is inclined upward and forward towards the lever body 226*a*. The cam assembly 216 is lowered with respect to the jaws 210, 212 so that the cams 218 are adjacent the lower end of each jaw 210, 212. The distal end portions 210*b*, 212*b* of the jaws are spaced by gap 214.

In FIG. 10, the heel 233 is positioned adjacent the cam surface 241. Note that in some embodiments, the heel 233 does not contact the cam surface 241; in other embodiments, the linkage 235 is configured to guide the heel 233 in contact with at least part of the cam surface 241 as the lever 226 pivots to the second lever position.

Figure 13:
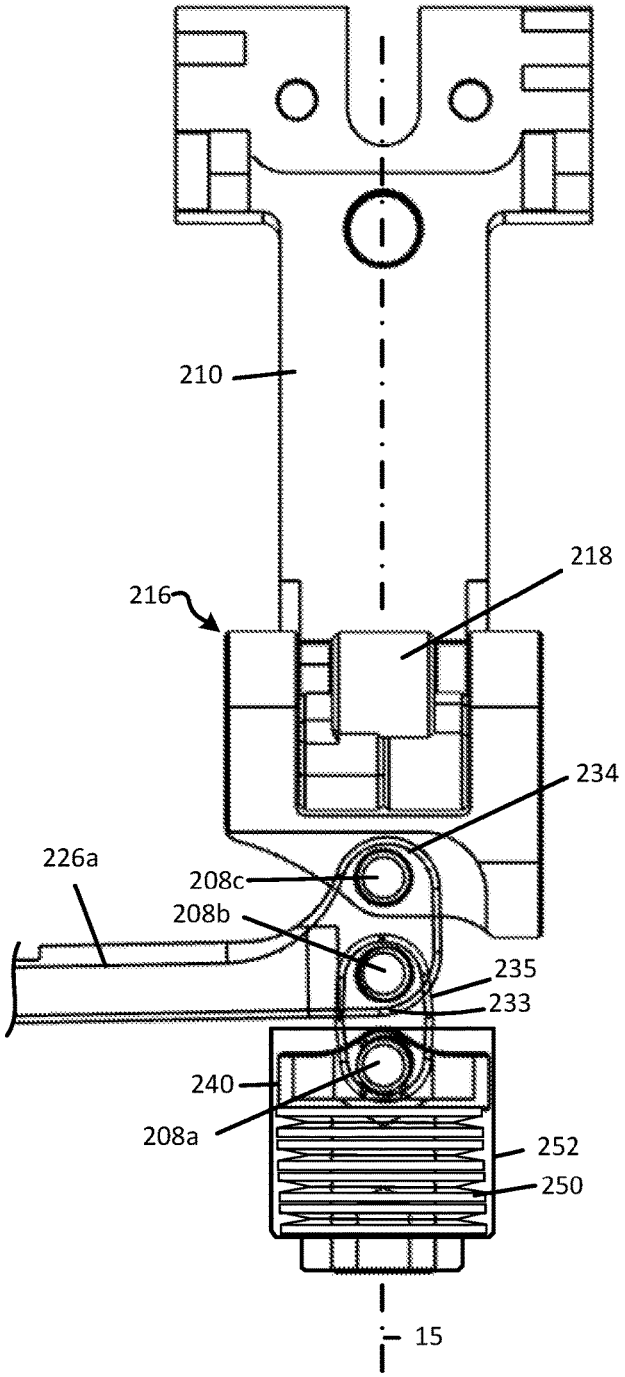
FIG. 13 illustrates a side view of part of a clamping assembly with the lever in between the first and second lever positions with the linkage vertically oriented along the central clamp axis, in accordance with an embodiment of the present disclosure.

Referring now to FIG. 13, a side view shows the clamp assembly 200 of FIG. 11 with the lever 226 in an intermediate position or position of maximum extension, in accordance with an embodiment. In this example, the right jaw 212 and clamp housing 204 are omitted for clarity. Note that the lever body 226*a* is oriented horizontally and extends forward of the clamp assembly 200. In this lever position the pins 208*a*, 208*b*, 208*c* connecting the toe 234, heel 233, linkage 235, and piston body 240 are linearly aligned along the central clamp axis 15. As illustrated, the linkage 235 is aligned vertically along the central clamp axis 15. This position can be referred to as the position of maximum extension, as noted above. Note that compared to FIG. 11, pin 208*a* connecting the heel 233 to the piston body 240 has a lower position in the receptacle 252 due to compression of the spring 250.

Figure 14:
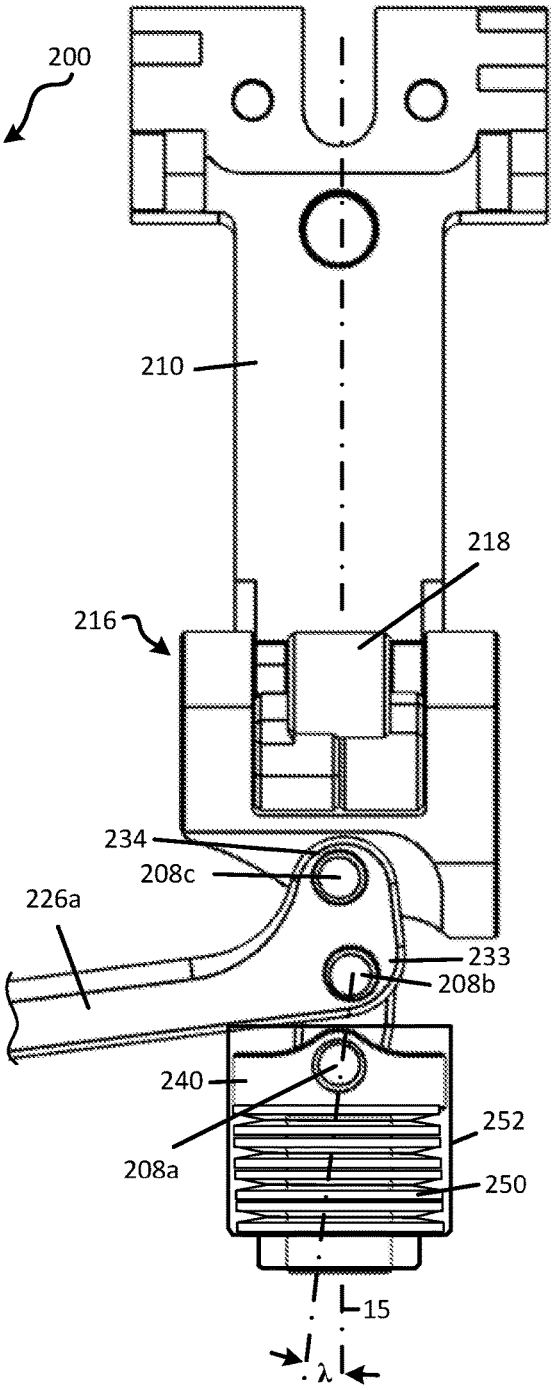
FIG. 14 illustrates a side view of the assembly of FIG. 13 with the lever moved to the second clamping position and the linkage inclined upward and rearward, in accordance with an embodiment of the present disclosure.

FIG. 14 illustrates a side view of the clamp assembly 200 of FIG. 11 with the lever 226 moved fully to the second lever position or "locked" position, in accordance with an embodiment. In this example, the right jaw 212 and clamp housing 204 are omitted for clarity. Note that the lever body 226*a* is inclined slightly downward and extends forward from the clamping assembly 200. Pin 208*c* connecting the toe 234 to the cam assembly 216 and pin 208*a* connecting the linkage 235 to the piston body 240 remain aligned along the central clamp axis 15. However, the pin 208*b* connecting the heel 233 to the linkage 235 has shifted slightly rearward past the central clamp axis 15. In this position, the linkage 235 is inclined upward and slightly rearward. In some embodiments, an axis through pins 208*a* and 208*b* defines an angle λ of 5-15° with the central vertical axis, including 8-12°, about 8°, and about 10°. As such, pins 208*a*, 208*b*, and 208*c* are no longer linearly aligned. In this position, the clamping assembly 200 is in a "locked" state where moving the lever 226 to the first lever position requires first moving the lever 226 to the position of maximum extension, such as shown in FIG. 13. From the position of maximum extension, the lever 226 can then move to the first lever position.

Figure 15:
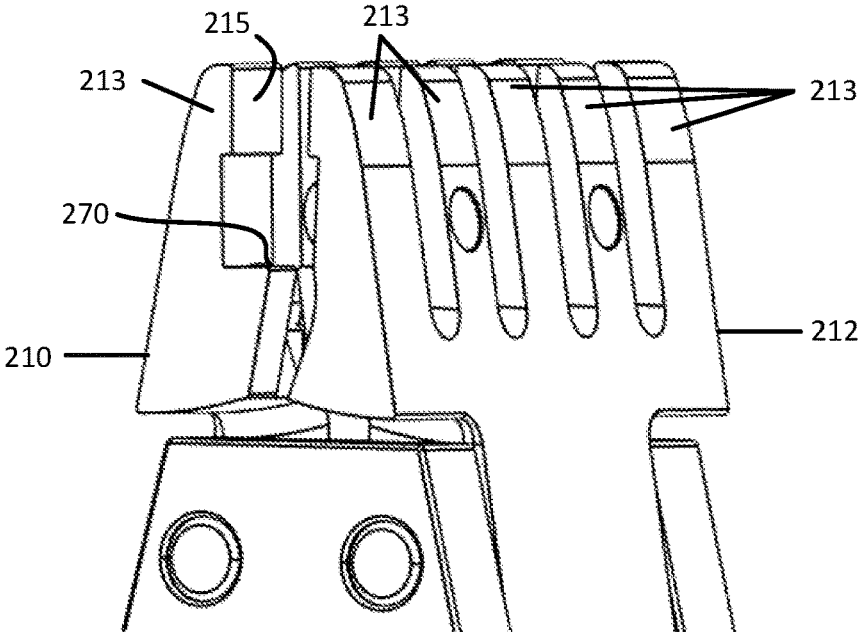
FIG. 15 illustrates a front perspective view showing jaws of a clamping assembly in an open condition, in accordance with an embodiment of the present disclosure.
Figure 16:
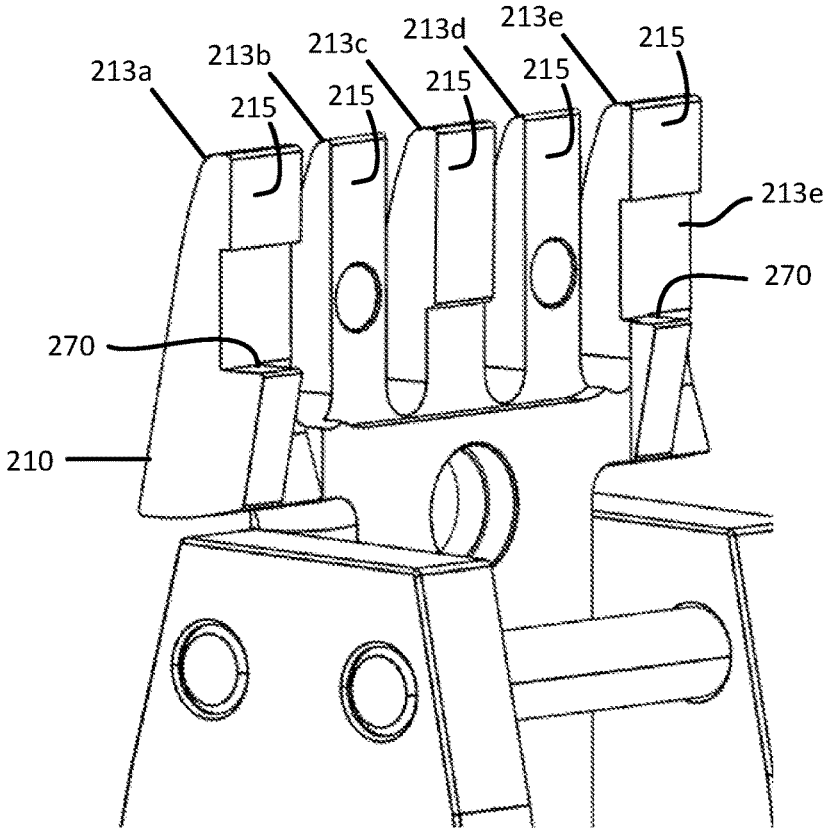
FIG. 16 illustrates a perspective view of a jaw with tines of different geometries, in accordance with an embodiment of the present disclosure.
Figure 17:
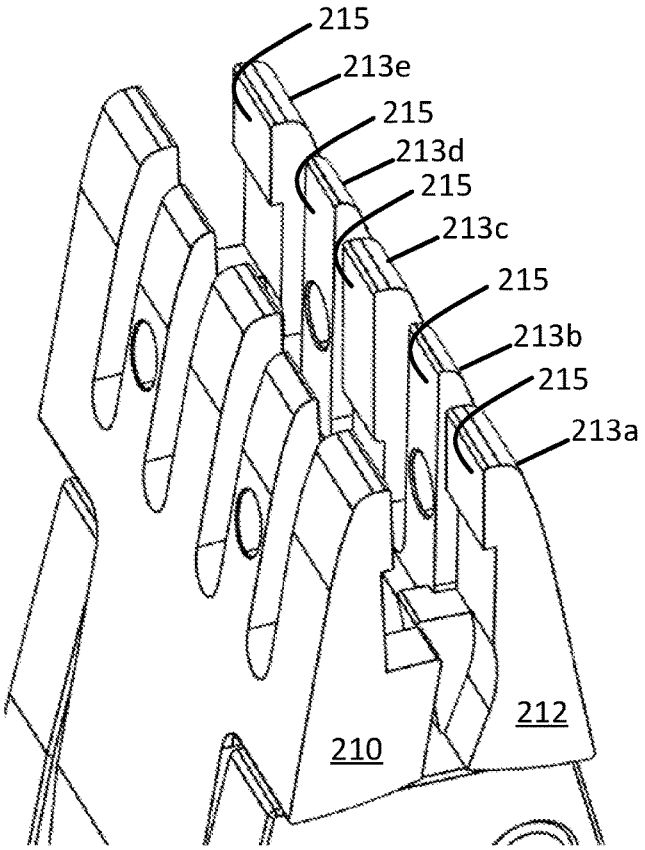
FIGS. 17 and 18 illustrate a top perspective views showing jaws in an open condition, where each jaw has tines of different geometries, in accordance with an embodiment of the present disclosure.

Referring now to FIGS. 15-18, various views illustrate jaws 210, 212 defining tines 213, in accordance with an embodiment. FIG. 15 illustrates a front perspective view of jaws 210, 212 in an open position, in accordance with an embodiment of the present disclosure. In this example, each jaw 210, 212 defines a plurality of vertical tines 213. FIG. 16 omits right jaw 212 to more clearly show tines 213 of the left jaw 210. In this example, each jaw 210, 212 defines five tines 213. End tines 213*a*, 213*e* define a horizontal shelf 270 that may be used to support the spine of a knife blade and facilitate a consistent horizontal orientation of the blade. The respective shelves 270 of jaws 210, 212 can be offset to permit overlap of the shelves 270.

In these examples, each jaw 210, 212 has five tines 213. Other numbers of tines 213 can be used including two tines, three tines, four tines, or more. The left jaw 210 need not have the same number of tines 213 as the right jaw 212. Some of tines 213 define a gripping surface 215 that protrudes laterally inward towards the median plane MP (shown in FIG. 18). In this example, the protruding gripping surfaces 215 of tines 213*a*, 213*c*, 213*e* extend laterally inward beyond the gripping surface 215 of tines 213*b*, 213*d*, which have a generally planar inside face. Also shown in this example, tines 213*a*, 213*c*, 213*e* having a protruding gripping surface 215 are interspersed with tines 213*b*, 213*d* having a generally planar gripping surface 215.

Figure 18:
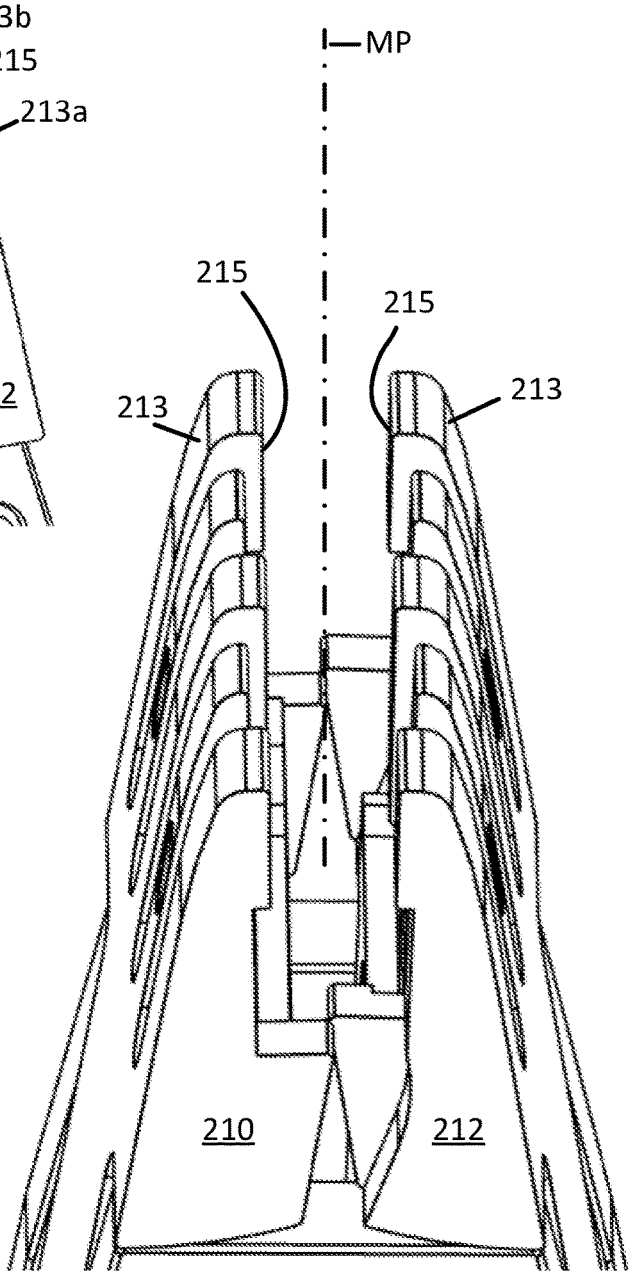

As can be seen in FIG. 18, jaws 210, 212 are in the open position and shelves 270 of opposite jaws 210, 212 may overlap to some extent. When jaws 210, 212 are moved to the closed position, shelves 270 intersect the median plane MP, particularly when gripping thin knife blades or other workpiece. Also visible in FIG. 18 is the different lateral positions of the gripping surfaces 215 of adjacent tines 213 of each jaw 210, 212.

Figure 19:
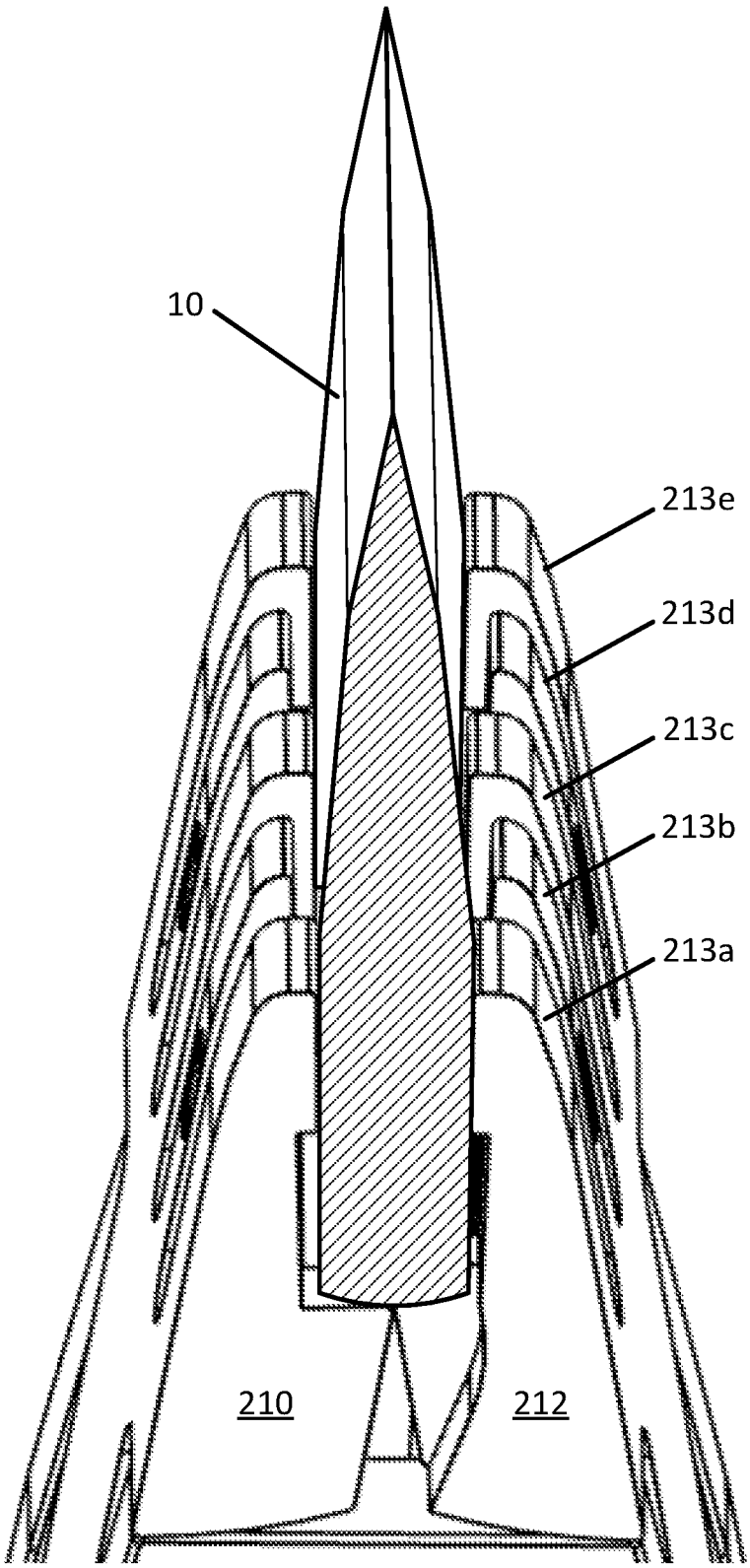
FIG. 19 illustrates a front, partial cross-sectional view showing jaws engaging a knife blade, in accordance with an embodiment of the present disclosure.

FIG. 19 illustrates a front and top perspective view of jaws 210, 212 and part of a workpiece 10. As shown here, for example, not all tines 213 contact the blade or workpiece in all situations. In one example, a relatively thick knife blade 10 may be held securely only by the protruding gripping surfaces of tines 213*a*, 213*c*, 213*e* and may not make contact with tines 213*b*, 213*d*. In another example, a knife having a blade thickness that reduces along its length may cause tines 213*a* to deform as jaws 210, 212 initially close on the blade, followed by tines 213*e* (and/or others) engaging the blade as lever 226 moves fully to the second lever position. In another example, a blade 10 of complex geometry may result in some tines deflecting as jaws 210, 212 tighten on the blade 10 with a combination of tines 213 engaging the blade 10 when the lever 226 is moved fully to the second lever position. Tines 213 can be made of aluminum or steel alloys, for example, both of which provide adequate flexibility and resiliency to conform to blade geometry when clamping and provide adequate rigidity to securely engage the blade 10.

FURTHER EXAMPLE EMBODIMENTS

The following examples pertain to further embodiments, from which numerous permutations and configurations will be apparent.

Example 1 is a clamping assembly comprising a base defining a spring well. A spring piston assembly is received in the spring well and includes a spring and a piston body. First and second jaws are supported in opposed, spaced-apart alignment on opposite sides of a central clamp axis that extends through the spring piston and between the first and second jaws. Each of the first and second jaws each has a proximal end portion adjacent the base and a distal end portion, where the first and second jaws are pivotable to move the first and second jaws between an open position and a closed position. A wedge is movable along the central clamp axis between the proximal end portions of the first and second jaws. A lever has an elongated lever body extending to a proximal lever end portion defining an L-shape with a toe and a heel, the toe pivotably connected to the wedge, where the lever is operable between a first lever position and a second lever position to move the wedge along the central clamp axis. A linkage couples the piston body to the heel of the proximal lever end portion so that compressing the spring increases an axial distance between the piston body and the wedge.

Example 2 includes the subject matter of Example 1, where when the first and second jaws engage a workpiece prior to the lever moving fully to the second lever position, compressing the spring enables moving the lever to the second lever position.

Example 3 includes the subject matter of Example 1 or 2, and further comprises a receptacle in the spring well with at least part of the spring piston in the receptacle, wherein the receptacle is selectively movable along the central clamp axis to change an axial position of the spring piston.

Example 4 includes the subject matter of Example 3, wherein the receptacle threadably engages the spring well such that rotating the receptacle in the spring well moves the body along the central clamp axis.

Example 5 includes the subject matter of Example 3, and further comprises a base plate in the spring well between the base and the spring, the base plate threadably engaging the spring well such that rotating the base plate moves the spring piston along the central clamp axis.

Example 6 includes the subject matter of Example 5, wherein the base plate has an annular shape with a central opening.

Example 7 includes the subject matter of Example 6, wherein the piston body includes a rod sized to be received in the central opening of the base plate.

Example 8 includes the subject matter of any of Examples 1-7, wherein moving the lever from the first lever position to the second lever position includes pivoting the lever downward, wherein the linkage is inclined upward and forward when the lever is in the first lever position, and wherein the linkage is inclined upward and rearward when the lever is in the second lever position.

Example 9 includes the subject matter of any of Examples 1-8, wherein the wedge comprises a first cam positioned to engage an inside surface of the first jaw and a second cam positioned to engage an inside surface of the second jaw.

Example 10 includes the subject matter of Example 9, wherein the wedge further comprises a yoke, wherein the first cam and the second cam are pivotably connected to the yoke.

Example 11 includes the subject matter of Example 9 or 10, wherein each of the first cam and the second cam comprises a roller.

Example 12 includes the subject matter of any of Examples 1-11, wherein the spring piston comprises a disc spring or a Belleville washer.

Example 13 includes the subject matter of any of Examples 1-12, wherein the base is oriented in a horizontal plane and the central clamp axis is a vertical axis.

Example 14 is a blade sharpener comprising a base defining a spring well and a spring piston assembly received in the spring well and including a spring and a piston body. First and second jaws are supported over the base in opposed, spaced-apart alignment on opposite sides of a central clamp axis that extends vertically through the spring piston and between the first and second jaws. The first and second jaws are pivotable between an open position and a closed position. A wedge is movable along the central clamp axis between the first and second jaws. A lever has an elongated lever body extending to a proximal lever end portion defining an L-shape with a toe and a heel. The proximal lever end portion is between the wedge and the spring piston with the toe pivotably connected to the wedge and the heel coupled to the piston body via a linkage. The lever is operable between a first lever position and a second lever position to move the wedge along the central clamp axis, where compressing the spring increases an axial distance between the piston body and the wedge.

Example 15 includes the subject matter of any of Examples 1-14, and further comprises a housing secured to the base, where the first and second jaws are pivotably attached to the housing.

Example 16 includes the subject matter of Example 14 or 15, and further comprises a mount movably attached to the base, the mount defining a receptacle. A guide rod has a ball end configured to be received in the receptacle.

Example 17 includes the subject matter of Example 16, wherein the receptacle comprises a permanent magnet and wherein the ball end comprises a ferromagnetic material.

Example 18 includes the subject matter of Example 16, wherein the mount includes a fastener extending towards the receptacle such that an end of the fastener is spaced from the receptacle by a gap, wherein the receptacle and fastener are configured and arranged to capture and retain the ball end of the guide rod in the gap.

Example 19 includes the subject matter of any of Examples 14-18, wherein moving the lever from the first lever position to the second lever position includes pivoting the lever downward, wherein the linkage is inclined upward and forward when the lever is in the first lever position, and wherein the linkage is inclined upward and rearward when the lever is in the second lever position.

Example 20 includes the subject matter of any of Examples 14-19, wherein the wedge comprises a yoke connected to the toe of the lever, a first cam positioned to engage an inside surface of the first jaw, and a second cam positioned to engage an inside surface of the second jaw, where the first and second cams are pivotably attached to the yoke.

Example 20 includes the subject matter of any of Examples 1-19, where a top of the piston body defines a domed cam surface configured to engage the heel of the lever during movement of the lever between the first lever position and the second lever position.

Example 21 includes the subject matter of any one of Examples 1-21, where one or both of the first and second jaws defines three or more tines extending upward, the tines configured to engage and retain a blade to be sharpened when the jaws are in the closed position.

Example 22 includes the subject matter of Example 21, where some of the three or more tines define a gripping surface that protrudes laterally towards a median plane of the blade sharpener to a greater extent than a gripping surface of another of the three or more tines.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

I claim:

1. A clamping assembly comprising:

a base defining a spring well;

a spring piston received in the spring well and including a spring and a piston body;

first and second jaws supported in opposed, spaced-apart alignment on opposite sides of a central clamp axis that extends through the spring piston and between the first and second jaws, the first and second jaws each having a proximal end portion adjacent the base and having a distal end portion, wherein the first and second jaws are pivotable between an open position and a closed position;

a wedge movable along the central clamp axis between the proximal end portions of the first and second jaws;

a lever having an elongated lever body extending to a proximal lever end portion defining an L-shape with a toe and a heel, the toe pivotably connected to the wedge, the lever operable between a first lever position and a second lever position to move the wedge along the central clamp axis; and a linkage coupling the piston body to the heel of the proximal lever end portion;

wherein moving the lever between the first lever position to the second lever position moves the wedge along the central clamp axis and wherein compressing the spring increases an axial distance between the piston body and the wedge; and wherein a top of the piston body defines a domed cam surface configured to engage the heel of the lever when the lever moves between the first lever position and the second lever position.

2. The clamping assembly of claim 1, wherein when the first and second jaws engage a workpiece prior to the lever moving fully to the second lever position, and compressing the spring enables moving the lever fully to the second lever position.

3. The clamping assembly of claim 2, further comprising a receptacle in the spring well, wherein at least part of the spring piston is in the receptacle, and wherein the receptacle is selectively movable along the central clamp axis to change an axial position of the spring piston.

4. The clamping assembly of claim 3, wherein the receptacle threadably engages the spring well such that rotating the receptacle in the spring well moves the piston body along the central clamp axis.

5. The clamping assembly of claim 3, further comprising a base plate in the spring well between the base and the spring, the base plate threadably engaging the spring well such that rotating the base plate moves the spring piston along the central clamp axis.

6. The clamping assembly of claim 5, wherein the base plate has an annular shape with a central opening, and wherein the piston body includes a rod sized to be received in the central opening of the base plate.

7. The clamping assembly of claim 1, wherein the central clamp axis is a vertical axis and moving the lever from the first lever position to the second lever position includes pivoting the lever downward, wherein the linkage is inclined upward and forward when the lever is in the first lever position, and wherein the linkage is inclined upward and rearward when the lever is in the second lever position.

8. The clamping assembly of claim 1, wherein the wedge comprises a first cam engaging an inside surface of the first jaw and a second cam engaging an inside surface of the second jaw.

9. The clamping assembly of claim 8, wherein the wedge further comprising a yoke, wherein the first cam and the second cam are pivotably connected to the yoke.

10. The clamping assembly of claim 8, wherein each of the first cam and the second cam comprises a roller.

11. The blade sharpener of claim 1, wherein one or both of the first and second jaws defines three or more tines extending upward, the tines configured to engage and retain a blade to be sharpened when the jaws are in the closed position.

12. The blade sharpener of claim 11, wherein some of the three or more tines define a gripping surface that protrudes towards a median plane of the blade sharpener to a greater extent than a gripping surface of another of the three or more tines.

13. A blade sharpener comprising:

a base defining a spring well;

a spring piston received in the spring well and including a spring and a piston body;

first and second jaws supported over the base in opposed, spaced-apart alignment on opposite sides of a central clamp axis that extends vertically through the spring piston and between the first and second jaws, the first and second jaws pivotable between an open position and a closed position;

a wedge movable along the central clamp axis between the first and second jaws;

a lever having an elongated lever body extending to a proximal lever end portion defining an L-shape with a toe and a heel, the proximal lever end portion positioned between the wedge and the spring piston with the toe pivotably connected to the wedge and the heel coupled to the piston body via a linkage, the lever operable between a first lever position and a second lever position to move the wedge along the central clamp axis, wherein compressing the spring increases an axial distance between the piston body and the wedge;

wherein a top of the piston body defines a domed cam surface configured to engage the heel of the lever during movement of the lever between the first lever position and the second lever position.

14. The blade sharpener of claim 13, further comprising a housing secured to the base, wherein the first and second jaws are pivotably attached to the housing.

15. The blade sharpener of claim 13, further comprising:

a rod mount movably attached to the base, the rod mount defining a receptacle;

a permanent magnet in the receptacle; and a guide rod with a ball end configured to be received in the receptacle, the ball end comprising a ferromagnetic material.

16. The blade sharpener of claim 15, wherein the receptacle is oriented on one side of the mount and the mount further comprises a fastener extending towards the receptacle from an opposite second side of the mount such that an end of the fastener is spaced from the receptacle by a gap, wherein the receptacle and fastener are configured and arranged to capture and retain the ball end of the guide rod in the gap.

17. The blade sharpener of claim 13, wherein moving the lever from the first lever position to the second lever position includes pivoting the lever downward, wherein the linkage is inclined upward and forward when the lever is in the first lever position, and wherein the linkage is inclined upward and rearward when the lever is in the second lever position.

18. The blade sharpener of claim 13, wherein the wedge comprises:

a yoke connected to the toe of the lever;

a first cam positioned to engage an inside surface of the first jaw, the first cam pivotably attached to the yoke; and a second cam positioned to engage an inside surface of the second jaw, the second cam pivotably attached to the yoke.

19. The blade sharpener of claim 13, wherein one or both of the first and second jaws defines three or more tines extending upward, the tines configured to engage and retain a blade to be sharpened when the jaws are in the closed position; and wherein some of the three or more tines define a gripping surface that protrudes towards a median plane of the blade sharpener to a greater extent than a gripping surface of another of the three or more tines.

20. A blade sharpener comprising:

a base defining a spring well;

a spring piston received in the spring well and including a spring and a piston body;

first and second jaws supported over the base in opposed, spaced-apart alignment on opposite sides of a central clamp axis that extends vertically through the spring piston and between the first and second jaws, the first and second jaws pivotable between an open position and a closed position;

a wedge movable along the central clamp axis between the first and second jaws;

a lever having an elongated lever body extending to a proximal lever end portion defining an L-shape with a toe and a heel, the proximal lever end portion positioned between the wedge and the spring piston with the toe pivotably connected to the wedge and the heel coupled to the piston body via a linkage, the lever operable between a first lever position and a second lever position to move the wedge along the central clamp axis, wherein compressing the spring increases an axial distance between the piston body and the wedge;

wherein one or both of the first and second jaws defines three or more tines extending upward, the tines configured to engage and retain a blade to be sharpened when the jaws are in the closed position; and wherein some of the three or more tines define a gripping surface that protrudes towards a median plane of the blade sharpener to a greater extent than a gripping surface of another of the three or more tines.

* * * * *